US006407326B1

(12) United States Patent
Kondo

(10) Patent No.: US 6,407,326 B1
(45) Date of Patent: Jun. 18, 2002

(54) ELECTRONIC MUSICAL INSTRUMENT USING TRAILING TONE DIFFERENT FROM LEADING TONE

(75) Inventor: Masao Kondo, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/790,916

(22) Filed: Feb. 22, 2001

(30) Foreign Application Priority Data

Feb. 24, 2000 (JP) ..... 2000-048374
Jan. 11, 2001 (JP) ..... 2001-003643

(51) Int. Cl.[7] ..... G10H 1/18; G10H 7/00
(52) U.S. Cl. ..... 84/615; 84/609; 84/622; 84/649; 84/653
(58) Field of Search ..... 84/600–606, 609–613, 84/615–620, 622–625, 634–637, 649–650, 653–657, 659–660, 666–669

(56) References Cited

U.S. PATENT DOCUMENTS 4,662,261 A * 5/1987 Akutsu ..... 341/20
5,610,353 A * 3/1997 Hagino ..... 84/604
6,118,065 A * 9/2000 Haruyama ..... 84/609

FOREIGN PATENT DOCUMENTS

JP 1-321488 12/1989

* cited by examiner

*Primary Examiner*—Marlon T. Fletcher
(74) *Attorney, Agent, or Firm*—Morrison & Foerster LLP

(57) ABSTRACT

In an electronic musical apparatus having a generator for generating a tone, a play member is provided for playing a music such that a key-on touch operation and a key-off touch operation are performed on the play member to input a note of the music. A detector detects the key-on touch operation and the key-off touch operation to generate key-on information and key-off information. A controller operates based on the key-on information and the key-off information for controlling the generator to generate a tone corresponding to the note. The detector detects a transitional state of the key-off touch operation for generating a sequence of first key-off information and second key-off information indicative of the transitional state of the key-off touch operation. The controller responds to the first key-off information for controlling the generator to start generating of a trailing tone of the note and responds to the second key-off information for controlling the generator to stop generating of the trailing tone of the note. The controller responds to the key-on information for controlling the generator to generate a leading tone of the note, which is then changed to a trailing tone of the same note in response to the first key-off information.

37 Claims, 20 Drawing Sheets

FIG.4 (1)
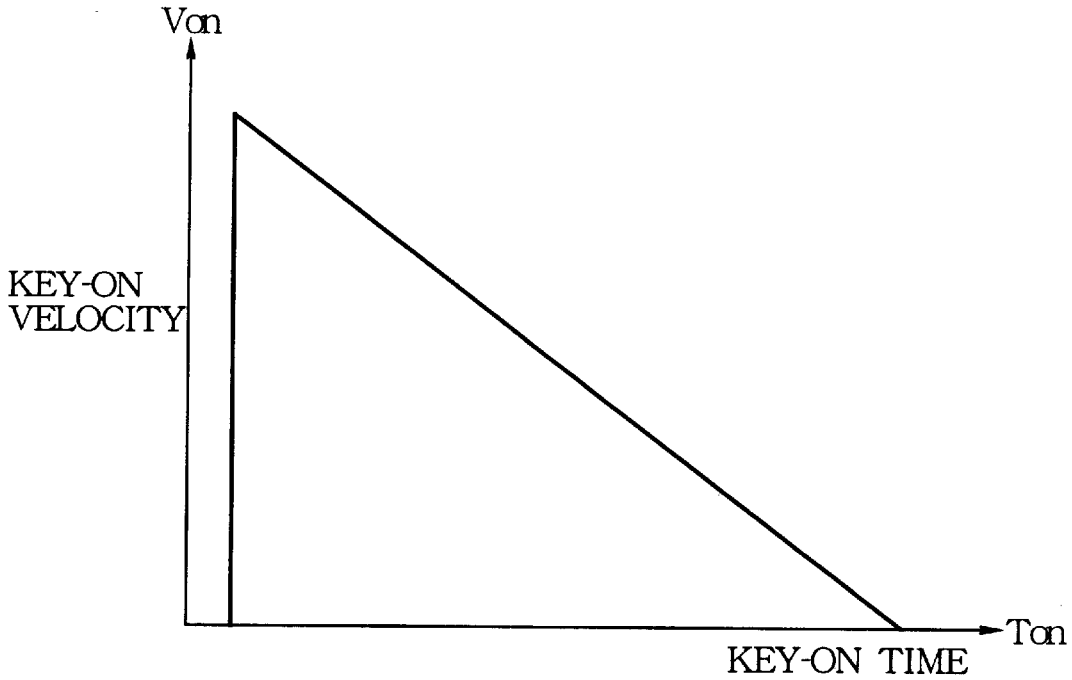
FIG.4 (2)
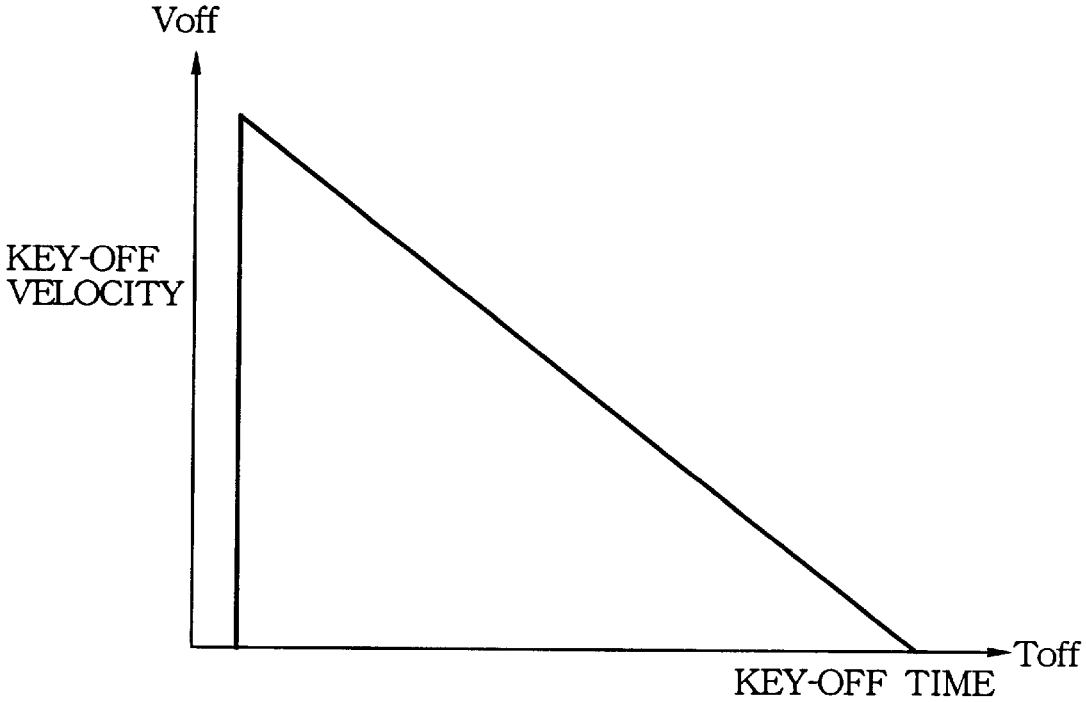

FIG.5 (1)
| CHANNEL NUMBER n | KEY CODE KC (n) | KEY EVENT TYPE KV (n) | KEY-ON VELOCITY Von (n) | KEY-OFF VELOCITY Voff (n+16) |
|---|---|---|---|---|
| 0 | KC1 | 101B | ••• | ••• |
| 1 | KC2 | 010B | ••• | ••• |
| 2 | ••• | ••• | | |
| | | | ••• | ••• |
| 14 | ••• | ••• | ••• | ••• |
| 15 | ••• | ••• | ••• | ••• |
| NR | CR | VR | VnR | VfR |
FIG.5 (2)
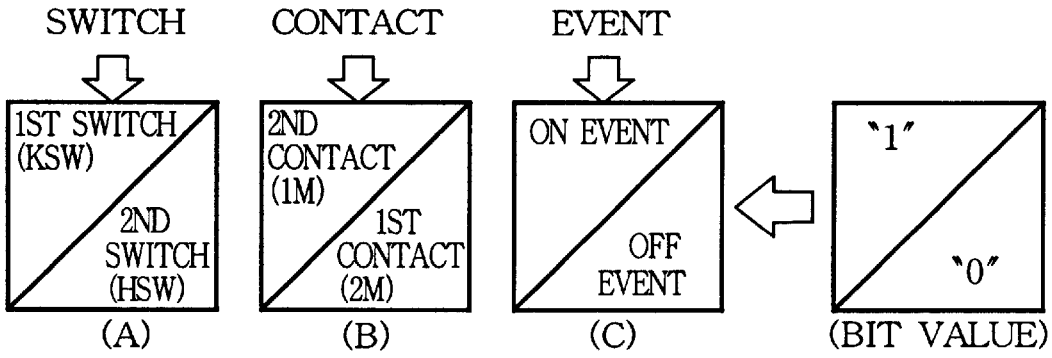

FIG.6 (1)

| CHANNEL NUMBER n | SWITCH FLAG TC (n) |
|---|---|
| 0 | 01B |
| 1 | ••• |
| 2 | |
| | ••• |
| 14 | ••• |
| 15 | ••• |

00B = NOT COUNTED
01B = Ton BEING COUNTED
10B = Toff BEING COUNTED
11B = COUNT ENDED

FIG.6 (2)

| CHANNEL NUMBER n | KEY-ON TIME Ton (n) | KEY-OFF TIME Toff (n+16) |
|---|---|---|
| 0 | ••• | ••• |
| 1 | ••• | ••• |
| 2 | ••• | |
| | | ••• |
| 14 | ••• | ••• |
| 15 | ••• | ••• |

STATES OF TC (n) :

00B = NOT COUNTED
01B = Ton BEING COUNTED
10B = Toff BEING COUNTED
11B = COUNTING ENDED STATES OF TC (n) :

00B = NOT COUNTED
01B = Ton BEING COUNTED
10B = Toff BEING COUNTED
11B = COUNTING ENDED

ELECTRONIC MUSICAL INSTRUMENT USING TRAILING TONE DIFFERENT FROM LEADING TONE

BACKGROUND OF THE INVENTION

1. Field of the Invention

The present invention relates generally an electronic musical instrument capable of generating tones expressive likewise an acoustic piano, and particularly relates to an electronic musical instrument for providing a naturally sounding key-off tone in response to a key-off touch.

2. Description of Related Art

Acoustic instruments such as acoustic pianos are constructed to forcibly mute the sounding by use of a muting member such as a damper when the muting is desired at a key-off operation. This distorts the sound waveform at muting from that of the original waveform due to the string vibration caused by a key-on operation. Such sound damping action varies in accordance with key-off touches, so that varying them can in turn vary sounds at muting, thereby enhancing user's expressive power of musical performance.

In order to achieve this purpose, related-art electronic musical instruments are configured to detect a velocity of a key-off operation and to control a sound signal in accordance with the detected velocity level to enhance the expressive power of musical performance (as disclosed in Japanese Published Examined Patent Application No. Sho 63-34473 for example). Another related electronic musical instrument (as disclosed in Japanese Published Unexamined Patent Application No. Hei 5-134671) creates acoustic piano damping effects by applying a limiter operation to key-off waveforms, thereby enhancing the expressive power of musical performance.

SUMMARY OF THE INVENTION

It is therefore a main object of the present invention to provide an electronic musical instrument which can create rich performance expression responsive to modes of key operation such as acoustic piano, and which imparts variations to key-on and key-off tones by key operations including key-on touch and key-off touch to thereby enrich the expression of generated tones. Especially, the main object of the present invention is to provide an electronic musical instrument configured to enhance the capabilities of tone control processing for key-off operations so that damping waveforms can be controlled in various manners in accordance with the key-off operations, thereby further enhancing the expression of musical performance at the time of key-off operations.

In a main aspect of the invention, an electronic musical apparatus having a generator for generating a tone, comprises a play member provided for playing a music such that a key-on touch operation and a key-off touch operation are performed on the play member to input a note of the music, a detector that detects the key-on touch operation and the key-off touch operation to generate key-on information and key-off information, and a controller operative based on the key-on information and the key-off information for controlling the generator to generate a tone corresponding to the note, wherein the detector detects a transitional state of the key-off touch operation for generating a sequence of first key-off information and second key-off information indicative of the transitional state of the key-off touch operation, and the controller responds to the first key-off information for controlling the generator to start generating of a trailing tone of the note and responds to the second key-off information for controlling the generator to stop generating of the trailing tone of the note.

In an additional aspect of the invention, an electronic musical apparatus comprises a play member provided for playing a music such that a key-on touch operation and a key-off touch operation are performed on the play member to input a note of the music, a detector that detects the key-on touch operation and the key-off touch operation to generate key-on information and key-off information, a generator controllable for generating a tone, and a controller operative based on the key-on information and the key-off information for controlling the generator to generate a tone associated to the note, wherein the detector detects a transitional state of the key-off touch operation for generating a sequence of first key-off information and second key-off information indicative of the transitional state of the key-off touch operation, the generator has a memory storing a waveform representing a tone corresponding to the key-off touch operation, and the controller controls the generator for reading out the waveform from the memory in response to the first key-off information to start generating of the tone corresponding to the key-off touch operation, and controls the generator to stop generating of the tone corresponding to the key-off touch operation in response to the second key-off information.

In a further aspect of the invention, an electronic musical apparatus comprises a play member provided for playing a music such that a key-on touch operation and a key-off touch operation are performed on the play member to input a note of the music, a detector that detects the key-on touch operation to output key-on information and that detects the key-off touch operation to output key-off information, a generator that has a first sound source for generating a first tone and a second sound source for generating a second tone, and a controller operative based on the key-on information for controlling the generator to generate the first tone from the first sound source, and operative based on the key-off information for controlling the generator to generate the second tone from the second sound source, the controller further controlling the generator to regulate a duration of the second tone according to the key-off information.

In a still further aspect of the invention, an electronic musical apparatus comprises a key member provided for performing a key-on touch operation in a forward stroke and a key-off touch operation in a return stroke so as to input a music note, a mass member linked to the key member to undergo a forward stroke in response to the forward stroke of the key member for imparting a weight to the key-on touch operation, and to undergo a return stroke in response to the return stroke of the key member, wherein the mass member has a stroke span set greater than a stroke span of the key member, a detector that has a first sensor for detecting the forward stroke and the return stroke of the key member to output key-off information in response to the key-off touch operation, and a second sensor for detecting the forward stroke and the return stroke of the mass member to output key-on information in response to the key-on touch operation, a generator that has a first sound source for generating a leading tone of the music note and a second sound source for generating a trailing tone of the music note, and a controller operative based on the key-on information outputted from the second sensor for controlling the generator to generate the leading tone from the first sound source, and being operative based on the key-off information outputted from the first sensor for controlling the generator to generate the trailing tone from the second sound source.

Generally, close observation of a piano key-off operation reveals that a string corresponding to a key that has been hit vibrates while reducing oscillation in a state where the string is placed very close to a damper felt. The damper felt is gradually applied to the string generating a key-off tone including a subtle harmonics tone, and is finally fully pressed against the string to mute the key-off tone. Therefore, a piano player can effectively vary his or her key-off touch to generate a variety of key-off tones, thereby achieving an intended key-off performance effect.

According to the main aspect of the present invention, there is provided an electronic musical instrument which detects a touch of a key for musical performance and controls the generation of a tone on the basis of the resultant touch information. First key-off touch information and second key-off touch information are generated in accordance with the musical performance made by use of the keys, the generation of key-off control information is started in response to the generation of the first key-off touch information to generate a key-off trailing tone, at least a portion of the key-off control information is stopped in response to the generation of the second key-off touch information. At the same time, the generated key-off tone is quickly muted. Namely, according to the invention, a state of a key for musical performance at the time of a key-off operation is grasped on the basis of the first key-off touch information and the second key-off touch information. First, the key-off control information is generated in accordance with the first key-off touch information to generate a key-off tone including a subtle harmonics tone produced by the key-off operation, then, in accordance with the second key-off touch information, the key-off control information is stopped and the key-off tone is quickly muted to control the key-off operation such that a quick muting process of damper felt application and subsequent damper felt pressing is simulated. Consequently, this novel constitution allows players to produce intended subtle key-off tones.

According to the additional aspect of the invention, there is provided an electronic musical instrument which detects a touch of a key for musical performance, and which controls the generation of a tone on the basis of the resultant touch information. In the instrument, tone waveform storage means or memory for storing tone waveforms is arranged, first key-off touch information and second key-off touch information are generated in accordance with a performance operation made through the key for musical performance, the generation of key-off control information is started on the basis of the first key-off touch information, a key-off tone is generated on the basis of a tone waveform read from the tone waveform storage means, and the generated key-off tone is quickly muted in response to the generation of the second key-off touch information. Consequently, this novel constitution allows users to store key-off tone waveforms including a subtle harmonics tone generated at a key-off operation into the tone waveform storage means beforehand, and allows users to generate, by use of the stored key-off tone waveforms, a key-off tone with a subtle harmonics tone generated at a key-off operation reflected with fidelity.

It should be noted that the tone waveform storage means preferably stores tone waveforms obtained by sampling the total waveform of a key-off tone generated by an acoustic musical instrument such as a grand piano (GP). Preferably, the key-off tone waveform may be configured for enabling loop reading, thereby saving the storage capacity of the waveform memory and providing simplified control functionality.

According to the further aspect of the invention, there is provided an electronic musical instrument which detects a touch of a key for musical performance, and which controls the generation of a tone on the basis of the resultant touch information. In the instrument, a first tone generator source and a second tone generator source are arranged, key-on information and key-off touch information are generated in accordance with a performance operation made by use of a key for musical performance, the generation of a tone on the basis of the first tone generator source is controlled by the key-on information, the generation of a tone on the basis of the second tone generator source is controlled by the key-off touch information. In accordance with a key-off touch level obtained from the key-off touch information, the length of a tone generated on the basis of the second tone generator source is controlled. Namely, in the present invention, the first tone generator source is used to generate a key-on leading tone in accordance with the key-on information generated by a key-on operation by use of a key for musical performance, and the second tone generator source is used to generate a key-off trailing tone in accordance with the key-off touch information, so that various types of sound sources may be used for each of these tone generator sources including mathematically generated waveforms such as FM tone generator in addition to a waveform memory to generate key-on and key-off tones, thereby providing variety of musical performance expressions. For example, both the tone generating sources may be of the same type, or one of the tone generator sources may be a waveform memory while the other may be an FM tone generator, or the second tone generator source may be a waveform memory. Further, because the length of a key-off tone is controlled in accordance with key-off touch level information, a key-off performance effect corresponding to a key-off operation can be obtained.

According to the still further aspect of the invention, the mass member pivots much more than the operation amount of the key member. For example, the total stroke of the mass member measured at a torque operating point or an actuating portion (second actuator 46 of the embodiment) to a sensor is set about three times as the total stroke of the key member measured at an operating point or an actuating portion (mass driver WA of the embodiment) to the mass member. In such settings, the leading or key-on waveform is read out in response to a switch event occurrence in the second sensor (on-event occurring at a forward key stroke), which is driven by the mass member during the key stroke in relatively deep operating position. The key-off or trailing waveform is read out in response to the switch event occurrence (off-event occurring in the reverse or return key stroke), which is driven by the key member during the key stroke in relatively shallow operating position. Thus, the inventive music apparatus has sounding/damping function quite similar to the acoustic piano, and realizes a natural and expressive sound system.

Either of the first and second sensors may be composed of a touch response switch having a touch response function to measure a differential detecting time by two contacts. In such a case, the second sensor may have a touch response function, while the first sensor may be composed of one contact type. Otherwise, both of the first and second sensors may have the touch response function. Particularly, the latter configuration can improve the expressive and natural sound generation effect.

BRIEF DESCRIPTION OF THE DRAWINGS

These and other objects of the invention will be seen by reference to the description, taken in connection with the accompanying drawings, in which:

FIGS. 4(1) and 4(2) illustrate examples of tables of conversion between time and velocity in the embodiment of the invention, wherein 4(1) shows an example of "Ton to Von conversion" table and 4(2) shows an example of "Toff to Voff conversion" table;

FIGS. 5(1) and 5(2) illustrate a format example of a buffer and timer areas in the embodiment of the invention, wherein FIG. 5(1) shows a format of a key buffer and FIG. 5(2) shows details of key-event type data;

FIGS. 6(1) and 6(2) illustrate a format example of the buffer and timer areas in the embodiment of the invention, wherein FIG. 6(1) shows a format of a switch flag buffer and FIG. 6(2) shows a format of a software counter area.

DETAILED DESCRIPTION OF PREFERRED EMBODIMENTS

This invention will be described in further detail by way of preferred embodiments with reference to the accompanying drawings. It should be noted that the preferred embodiments described below are only examples, and therefore changes and variations may be made without departing form the spirit or scope of the present invention. For example, in acoustic pianos, no damper felt is arranged for a high range. Introducing a method of damper usage depending on ranges as noted above into the description of the present invention only makes it difficult to understand the system configuration of the embodiment, providing little merit in understanding the features of the invention. Therefore, in the embodiment described below, it is assumed that the damper felt be uniformly arranged over all the ranges, namely the higher-pitch keys be also applied with the damper felt before being muted. Alternatively, the high range may be treated without use of damper felt as disclosed in Japanese Published Unexamined Patent Application No. Hei 5-134671.

Figure 1:
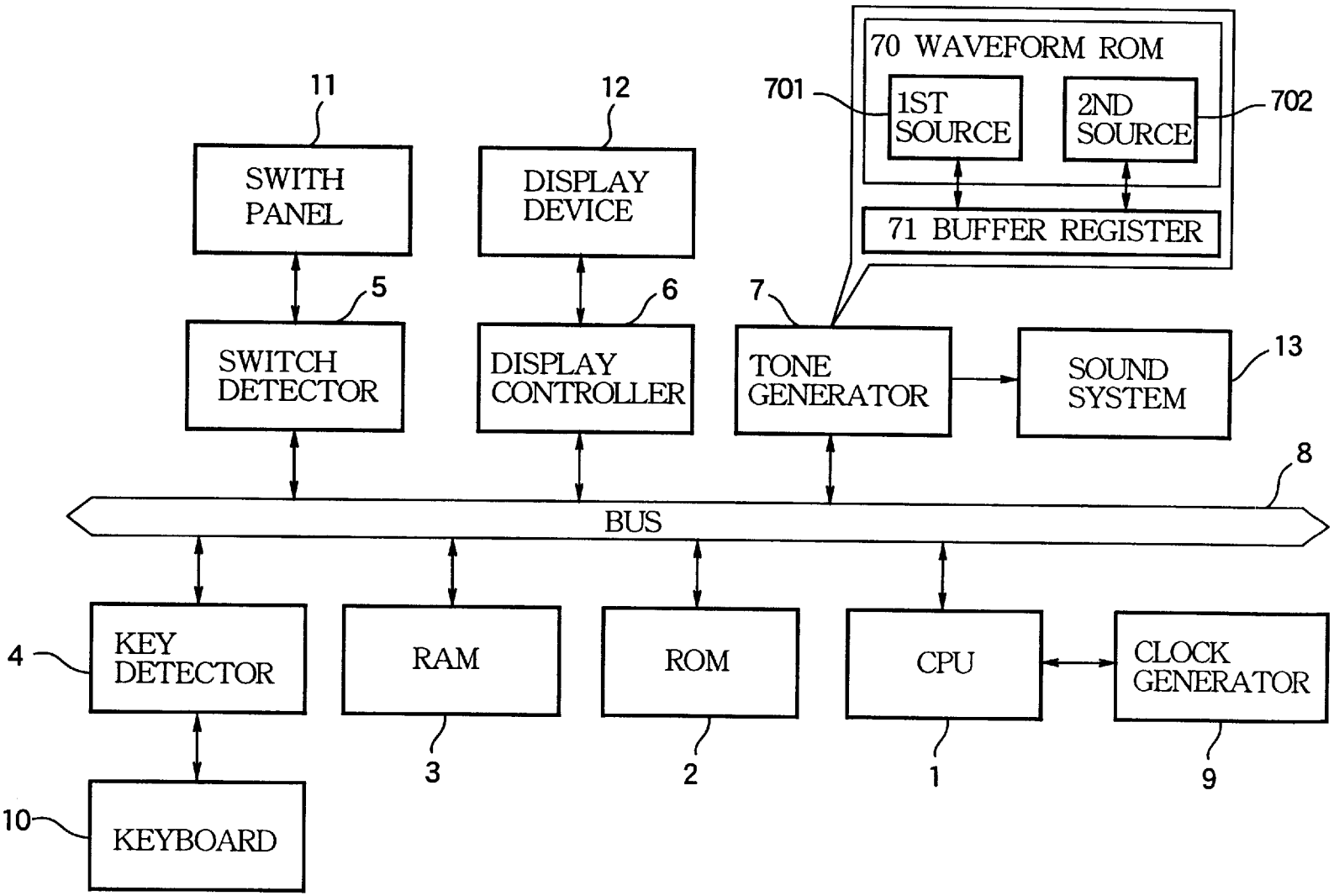
FIG. 1 is a block diagram illustrating a hardware configuration of an electronic musical instrument practiced as one preferred embodiment of the invention.

Hardware Configuration:

Now, referring to FIG. 1, an electronic musical instrument practiced as one preferred embodiment of the invention comprises a CPU (Central Processing Unit) 1, a ROM (Read Only Memory) 2, a RAM (Random Access Memory) 3, a key-on/key-off detector 4, a switch detector 5, a display controller 6, and a tone generator 7, those of which are interconnected by a bus 8.

The CPU 1 for controlling the system in its entirety has a clock generator 9 which generates a clock for driving the CPU 1 and an interrupt clock for use in capturing key-touch information in accordance with a predetermined program, and mainly for use in key-off processing to be described later. The ROM 2 stores predetermined control programs for controlling the present electronic musical instrument, these programs including various processing programs associated with key-on and key-off operations, various predetermined tables including "Ton to Von conversion" table TBL1 and "Toff to Voff conversion" table TBL2, and various kinds of control data according to the present invention.

The RAM 3 stores data and parameters necessary for executing the above-mentioned processing operations and serves as a work area for temporarily holding various registers and flags and various data being processed. For example, allocated in the RAM 3 are buffers such as a key buffer KEYBUF and a switch flag buffer TCBUF, a counter area, registers, a temporary memory area AR. The key buffer KEYBUF temporarily holds key codes KC(n), key event types KV(n), and velocity data Von(n) and Voff(n+16) corresponding to a sounding channel n. The switch flag buffer TCBUF temporarily holds switch flags TC(n) corresponding to the channel n.

The counter area is provided in the RAM 3 for measuring a setting time difference caused by a key switch for obtaining key-on/key-off touch information, as a software counter area for counting key-on times Ton(n) and key-off times Toff(n+16). The temporary memory area AR temporarily stores current tone waveform peak value (instantaneous value) data L(n) for sounding channel n. The registers also include a rate register for holding a damping rate. It should be noted that channel number "n" denotes one of integers 0 through 15 for example. In correspondence, the tone generator 7 has 32 channels 0 through 31 for example, n channels being allocated to key-on and n+16 channels to key-off.

The key-on/key-off detector 4 is incorporated in a keyboard player device (or simply a keyboard) 10 having play controls such as a keyboard and connected to the CPU 1 and other components via the bus 8. A switch panel 11 connected to the switch detector 5 has various controls for setting musical performance conditions such as timbres and effects.

A display device 12 composed of various indicators is connected to the bus 8 via the display controller 6 and arranged around the controls on the switch panel 11. The display device 12 may also display various setting screens and various operator buttons, thereby allowing the user to make various setting operations on the screen.

The tone generator 7 includes a waveform ROM 70 storing waveforms generated and controlled when a key, a play control, is operated and a buffer register 71 for transferring data with the CPU 1. The waveform ROM 70 is composed of a first tone generator source 701 containing a key-on waveform for use in generating a leading tone at a key-on operation and a second tone generator source 702 containing a key-off waveform for use in generating a trailing tone at a key-off operation.

When the keyboard 10 is operated, on the basis of the contents in the ROM 2, the CPU 1 executes a key operation processing program (refer to FIGS. 9 through 15) to read out a waveform from the waveform ROM 70. The waveform is reproduced as a tone corresponding to the key operation from a sound system 13 composed of a D/A converter, an amplifier, and a loudspeaker. It should be noted that an effector circuit constituted by a DSP and so on is also included in this sound system 13.

Figure 2:
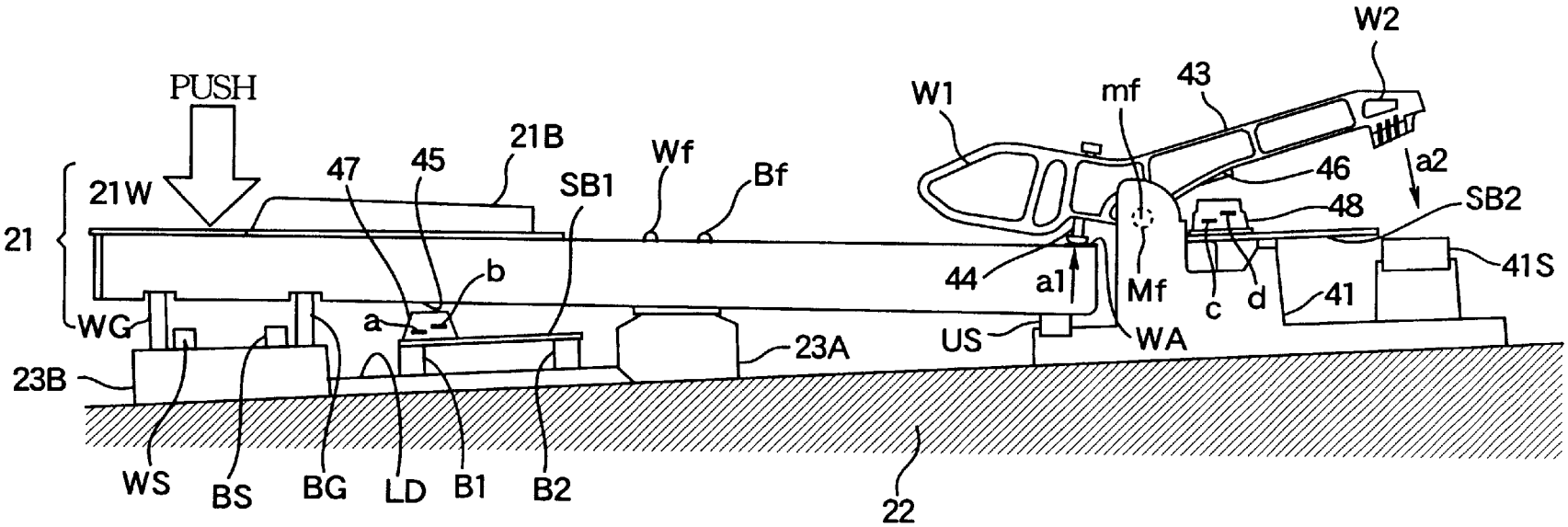
FIG. 2 is a schematic cross sectional view illustrating exemplary configuration of a keyboard playing device and a key-on and key-off detecting mechanism according to the preferred embodiment of the invention.

Key-on/key-off detecting mechanism:

The following describes an key-on/key-off detecting mechanism according to the preferred embodiment of the invention. FIG. 2 shows keys of the keyboard according to the invention, provided in a mechanism for capturing key operation information into the electronic musical instrument. This figure schematically illustrates a cross section of keys of the keyboard 12 with key in an unpressed state.

The keyboard 12 shown in FIG. 2 has many keys 21 each composed of a white key 21W and a black key 21B and a mass body 43 which is moved in response to the key 21. A keyboard support plate 22 of the musical instrument is fixed with a main key support 23A and a sub key support 23B, both of which constitute a key support 23. The main key support 23A is fixed with pivot pins Wf and Bf. The white key 21W is pivotally supported on the pivot pin Wf and the black key 21B on the pivot pin Bf. The front portion (the left side portion in the figure) of the key 21 is arranged with a key guides WG and BG projecting from the sub key support 23B. These key guides WG and BG guide the key actions of the white key 21W and the black key 21B pressed separately. The sub key support 23B is arranged with a white key lower limit stopper WS and a black key lower limit stopper BS.

In the key support 23, the main key support 23A and the sub key support 23B are linked with each other in a ladder fashion by means of a connector LD which is fixedly and integrally formed with the main key support 23A and the sub key support 23B. Between the connector LD and below the key 21, a first switch (SW) 47 is arranged on a base plate SB1, which is arranged on the keyboard support plate 22 via supports B1 and B2. On the rear portion of the key 21, a mass body support 41 having a pivot Mf is fixed to the keyboard support plate 22. A pivot mf of the mass body 43 made of plastics and containing weights W1 and W2 is supported on the pivot Mf, thus holding the mass body 43 on the mass body support 41. The upper portion of the mass body support 41 is arranged with an upper limit stopper US on the front side and a stopper 41S on the rear side.

The mass body 43 is arranged so as to be driven by a mass body driver WA on the rear upper surface of the key 21 via a force transmitting member 44. The force transmitting member 44 transmits a force to the mass body when the key is pressed and, at the same time, serves as a fine adjustment screw for adjusting sounding position. The mass body driver WA of the key 21 has a smooth worked face. Further, between the mass body 43 and the mass body support 41, a base plate SB2 is arranged on the mass body support 41. On the base plate SB2, a mass body drive switch 48 is arranged to constitute a second switch (SW). The key 21W (21B) is stationary with its rear end abutting with the upper limit stopper US when the key is in an unpressed or released state. When the key is pressed, the front side of the switch 48 abuts the stoppers WS and BS, in which the lower rear side of the mass body 43 abuts the stopper 41S. At this moment, the impact of the mass body 43 is mitigated by the stopper 41S, thereby lowering mechanical noise.

Configured as above, pressing the key in the direction of a white arrow shown in FIG. 2 pivotally moves the rear side of the key 21 and the front side of the mass body 43 in the upper direction indicated by arrow al and the rear side of the mass body 43 in the downward direction indicated by arrow a2. When the key is released, the key 21 and the mass body 43 pivotally move in the direction opposite to the arrows, thereby returning to the positions shown.

In the present embodiment of the invention, key pressing and key release strokes are detected by the first and second switches 47 and 48. In the example shown in FIG. 2, a first actuator 45 and a second actuator 46 are arranged on the lower faces of the key 21 and the mass body 43 respectively, thereby driving the first switch 47 and the second switch 48 each having two contacts. The mass body 43 is constructed to pivot much more than the operation amount of the key 21W (21B). The mass body 43 rotates through a wide angle 6 or 7 times as the rotating angle of the key 21W (21B). By such a configuration, the displacement ratio is set to about 1:3 between the respective torque operating points (mass body driving portion WA and second actuator portion 46). Thus, the second switch (SW) 48 driven by the mass body 43 functions as a second sensor, which detects an on-event for reading out the key-on waveform during a latter half period of the forward depressing key stroke (relatively deep operating positions C, D as will be described later in conjunction with FIG. 3). Then, the first switch (SW) 47 driven by the key 21 functions as a first sensor for detecting an off-event to read out the key-off waveform during a first half period of the return or release key stroke (at relatively shallow operating positions A, B shown FIG. 3). Both of the first and second sensors may have a function of key velocity sensor of differential contact types.

The actuators 45 and 46 and the switches 47 and 48 are so related that, in a key pressing stroke, the first actuator 45 abuts the first switch 47 and, with a certain delay, the second actuator 46 abuts the second switch 48. The first and second switches 47 and 48 are 2-make touch response switches of contact time differential type having two rubber contacts "a" and "b", and "c" and "d", respectively. A stroke difference is set to a make (on) operation and a break (off) operation at each contact. The first and second switches 47 and 48 respectively constitute a key release velocity sensor and a key pressing velocity sensor. As show in FIG. 2, a gap between the actuator portion 46 and the second switch 48 is set wider than a gap between the actuator portion 45 and the first switch 47.

This has two meanings. First, the displaceable span of the mass body 43 is set greater than the displaceable span of the key 21. Second, the movable distance of the mass member 43 in the up and down direction at the torque operating point (switch driving point) is set greater than that of the key 21 (smaller than the displaceable distance at rear end of the mass body). As to reason of the first aspect, the displacement distance of the mass body linked to the key is increased with out raising a total weight of the keyboard for obtaining a responsive key touch, namely for increasing an inertial mass. As to the reason of the second aspect, it is better to carry out the velocity sensing by the hammer hit sensor 48 at a position corresponding to the last position where the hammer hits the string as in a string hit mechanism of the acoustic piano. The switch 48 is driven at the actuating portion (46) of the mass body close to a rotational center thereof rather than the rear end of the mass body, in order to reduce a probability of chattering just after the string hit (namely, in order to prevent rebounding at the hitting of the string). Even under such a configuration, the displaceable span of the mass body 43 at the switch actuating portion in the up and down direction is expanded about three times as that of the key 21, as shown in FIG. 2.

To be more specific, in the first switch 47, when the first actuator 45 abuts the first switch 47 in a key pressing stroke for example, the first contact "a" of the first switch 47 makes (on) to start an "on" interval (an interval in which only one contact is making of the first switch 47, followed by the making of the second contact "b" of the first switch 47 to end the "on" interval of the first switch 47. The same holds true with the second switch 48. For example, if the second actuator 46 abuts the second switch 48 in a key pressing stroke for example, the first contact "c" of the second switch 48 makes to start an "on" interval of the second switch 48, followed by the making of the second contact "d" of the second switch 48 to end the "on" interval of the second switch 48. In a key release stroke, reverse operations take place; namely, the contact "d" and the contact "c" of the second switch and the contact "b" and contact "a" of the first switch break in this order, thereby indicating transitional states of the key-off operation.

It should be noted that the details of the structures of the key-on/key-off detecting mechanism and the first and second switches and their modifications are also disclosed in Japanese Patent Application No. Hei 11-271402.

Figure 3:
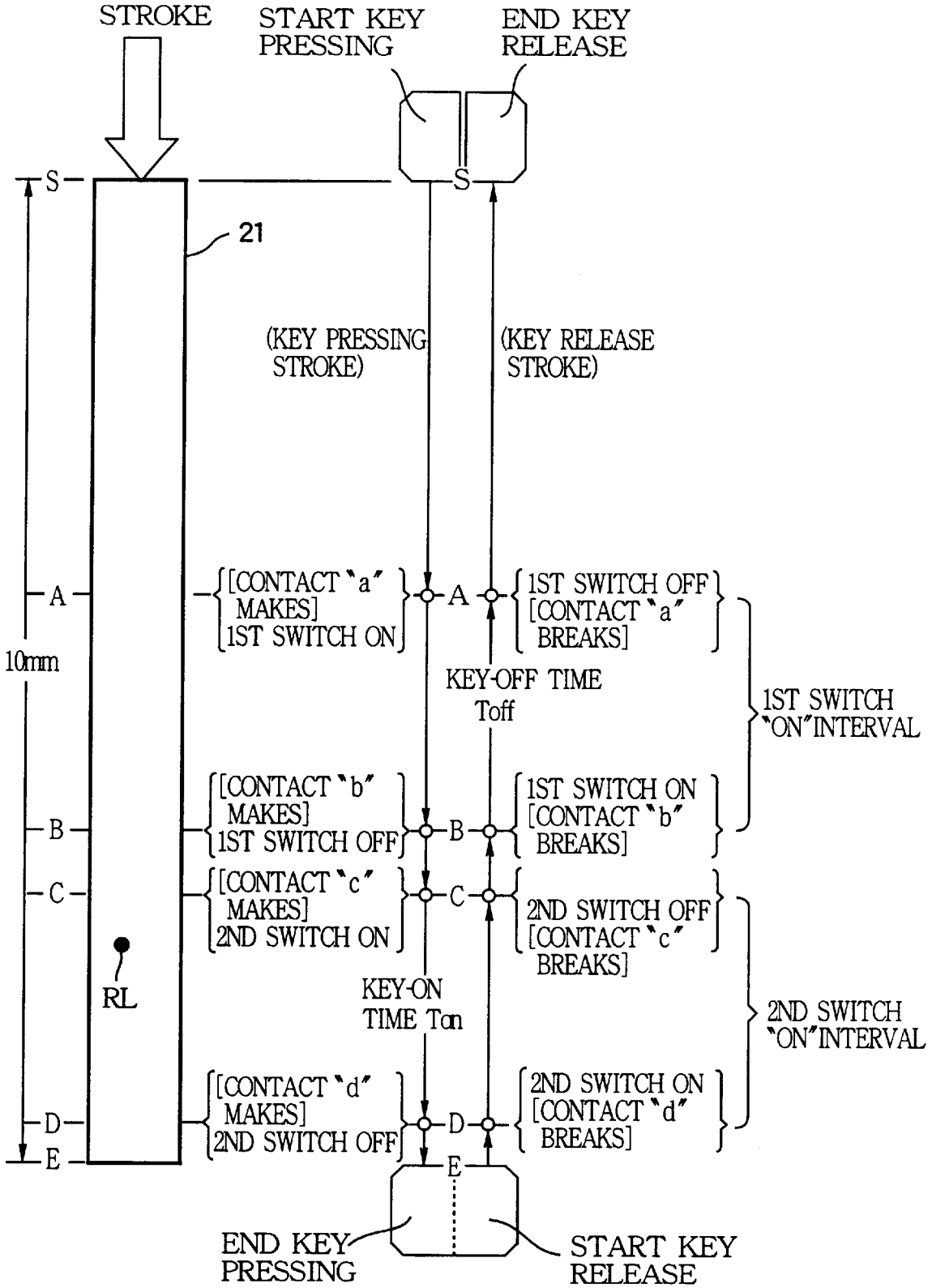
FIG. 3 is a diagram illustrating operation of a key switch used in the embodiment of the invention.

Key events:

Referring to FIG. 3, there is shown operation of the key switches of the present embodiment. Each key 21W of the keyboard 12 is configured so as to be vertically displaced to a deepest key-on position E from a key released (unpressed) position S, a maximum of 10 mm for example. On the other hand, the first and second contacts "a" through "d" of the key switches, namely the first and second switches 47 and 48, make at key positions A through D respectively when the key 21 is pressed and break at key positions A through D respectively when the key 21 is released.

For example, when the key 21 is pressed fully from the key release (unpressed) position S to the deepest key-on position E, in the key pressing stroke in the downward direction, the first contact "a" of the first switch 47 makes (on) at key position A to start the "on" interval of the first switch 47. When the key 21 reaches key position B, the second contact "b" of the first switch 47 makes to end the "on" interval of the first switch 47. At key position C, the first contact "c" of the second switch 48 makes to start the "on" interval of the second switch 48. When the key 21 reaches key position D, the second contact "d" of the second switch 48 makes to end the "on" interval of the second switch 48. Subsequently, the key 21 reaches the deepest key-on position E.

Conversely, in a key release stroke of the key 21 in the upward direction from the deepest key-on position E, the second contact "d" of the second switch 48 breaks at key position D to start the "on" interval of the second switch 48. When the key 21 reaches key position C, the first contact "c" of the second switch 48 breaks to end the "on" interval of the second switch 48. At key position B, the second contact "b" of the first switch 47 breaks to start the "on" interval of the first switch 47. When the key 21 reaches key position A, the first contact "a" of the first switch 47 breaks to end the "on" interval of the first switch 47. Subsequently, the key 21 returns to the key release state (unpressed), thereby completing the key pressing and release strokes.

In the above-mentioned example, the makes (on) and breaks (off) of the four contacts "a" through "d" are always checked and the timings and directions of changes between on and off states are monitored, thereby generating a key event consisting of 8 types of on (make) and off (break) events in all. To be more specific, 4 on-events are generated when the contacts "a" and "b" of the first switch 47 and the contacts "c" and " d" of the second switch 48 make at key positions A through D respectively, and 4 off-events are generated when these contacts break at key positions A through D respectively. Therefore, in order to generate touch information, operation time differences between the contacts "a" through "d" are measured by event intervals, contacts "a", "b", "c" and "d" sequentially make respectively in a key pressing stroke, and break, respectively in a key release stroke. On the basis of these key events, sounding and muting control information is obtained.

For example, in a key pressing stroke, a key-on time Ton(n) is measured between position C and position D and a count value equivalent to the key-on time Ton(n) is stored in the counter area of the RAM 3. The stored count value is then converted into a key-on velocity value Von(n) by use of the "Ton to Von conversion" table TBL1 shown in FIG. 4(1) to thereby determine a key-on velocity Von(n). At position D, a sounding start timing is determined for instructing the tone generator 7 to start sounding. In a key release stroke, a key-off time Toff(n+16) is measured between position B and position A and a count value equivalent to the key-off time Toff(n+16) is stored in the counter area of the RAM 3. The stored count value is converted into a key-off velocity value Voff(n+16) by the "Toff to Voff conversion" table TBL2 shown in FIG. 4(2) to thereby determine a key-off velocity Voff(n+16). At position A, a muting start timing is determined for instructing the tone generator 7 to start muting.

It should be noted that setting a rebound limiting position RL for rebounding of the mass body 43 when it is pressed in a key pressed state detection timing between position C and position D may prevent the chattering due to the rebound from taking place.

Configuration of control data:

Referring to FIGS. 5 and 6, there are shown the formats of buffer and timer areas allocated in the RAM 3. To be more specific, FIG. 5(1) indicates the format of a key buffer KEYBUF for storing sounding information and muting information of each channel (CH) n. FIG. 5(2) indicates details of key event type data KV(n). FIG. 6(1) indicates the format of a switch flag buffer TCBUF for storing a switch flag TC(n) for each channel n. FIG. 6(2) indicates the format of a software counter area for measuring key-on time Ton(n) and key-off time Toff(n+16) for each channel n.

The key buffer KEYBUF, as shown in FIG. 5(1), is formed with a channel number region NR indicative of sounding channel number n (in this example, a total of 16 channels 0 through 15), a key code storage region CR for storing key code data KC(n), a key event type storage region VR for storing key event type data KV(n), a key-on velocity storage region VnR for storing key-on velocity data Von(n), and a key-off velocity region VfR for storing key-off velocity data Voff(n+16).

The key event type data KV(n) indicate the type of a key event in 3 bits for example. Namely, as shown in FIG. 5(2), bit 3 (A) denotes a switch type; when this bit is "0", it indicates the second switch 48 (HSW) and when it is "1", it indicates the first switch 47 (KSW). Bit 2 (B) denotes a contact type; when this bit is "0", it indicates the second contact ("b" or "d") (2M) and when it is "1", it indicates the first contact ("a" or "c") (1M). Bit 1 (C) denotes an event type; when this bit is "0", it indicates an "off" (break) event and when it is "1", it indicates an "on" (make) event. For example, in the example shown in FIG. 5(1), key event type data KV(0)="101"B in channel 0 (CH0) (symbol "B" indicates that the value to which the symbol is attached is binary") indicate the on (make) event of the second contact "b" (2M) of the first switch 47 (KSW), key event type data KV(0) of channel 1 (CH1)="010"B in channel 1 (CH1) indicate the off (break) event of the first contact "c" (1M) of the second switch 48 (HSW).

The switch flag TC(n) takes one of the four status values "00"B, "01"B, "10"B and "11"B according to the process of a key event. These status values represent the following states as shown in the legendary of FIG. 6(1):

(1) TC(n)="00"B denotes a state in which neither key-on time Ton(n) nor key-off time Toff(n) is counted;
(2) TC(n)="01"B denotes a state in which key-on time Ton(n) is being counted;
(3) TC(n)="10"B denotes a state in which key-off time Toff(n) is being counted; and
(4) TC(n)="11"B denotes a state in which key-on counting has ended.

Waveforms for tone generation:

The present embodiment of the invention uses a factory set presampling sound source for "key-on waveform" data used in sounding (key-on) processing and "key-off waveform" data used in muting (key-off) processing. These waveform data are stored in the tone generator 7.

Figure 7:
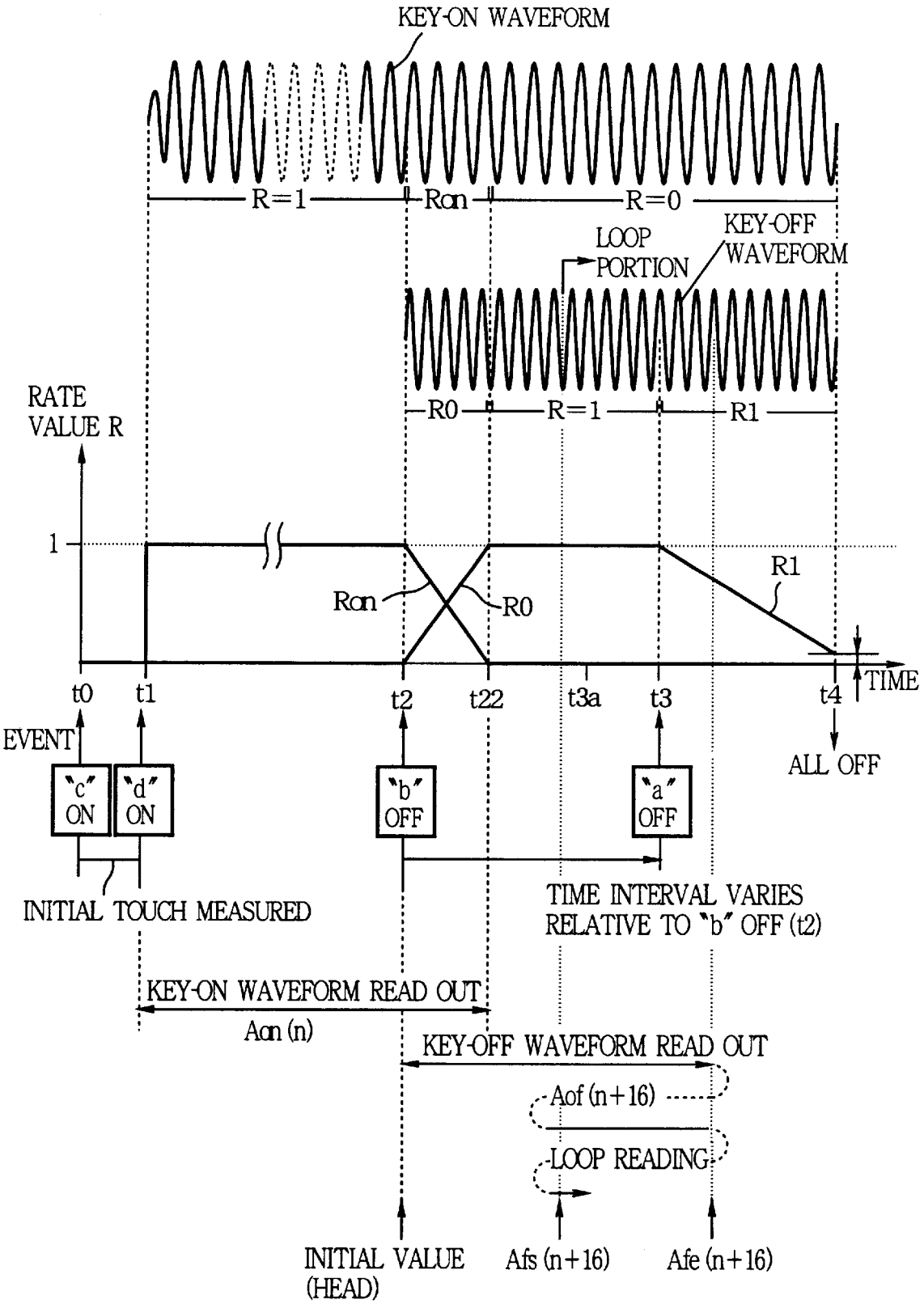
FIG. 7 is a diagram for describing a key-off waveform reading operation and a key-off waveform control operation in the embodiment of the invention.
Figure 14:
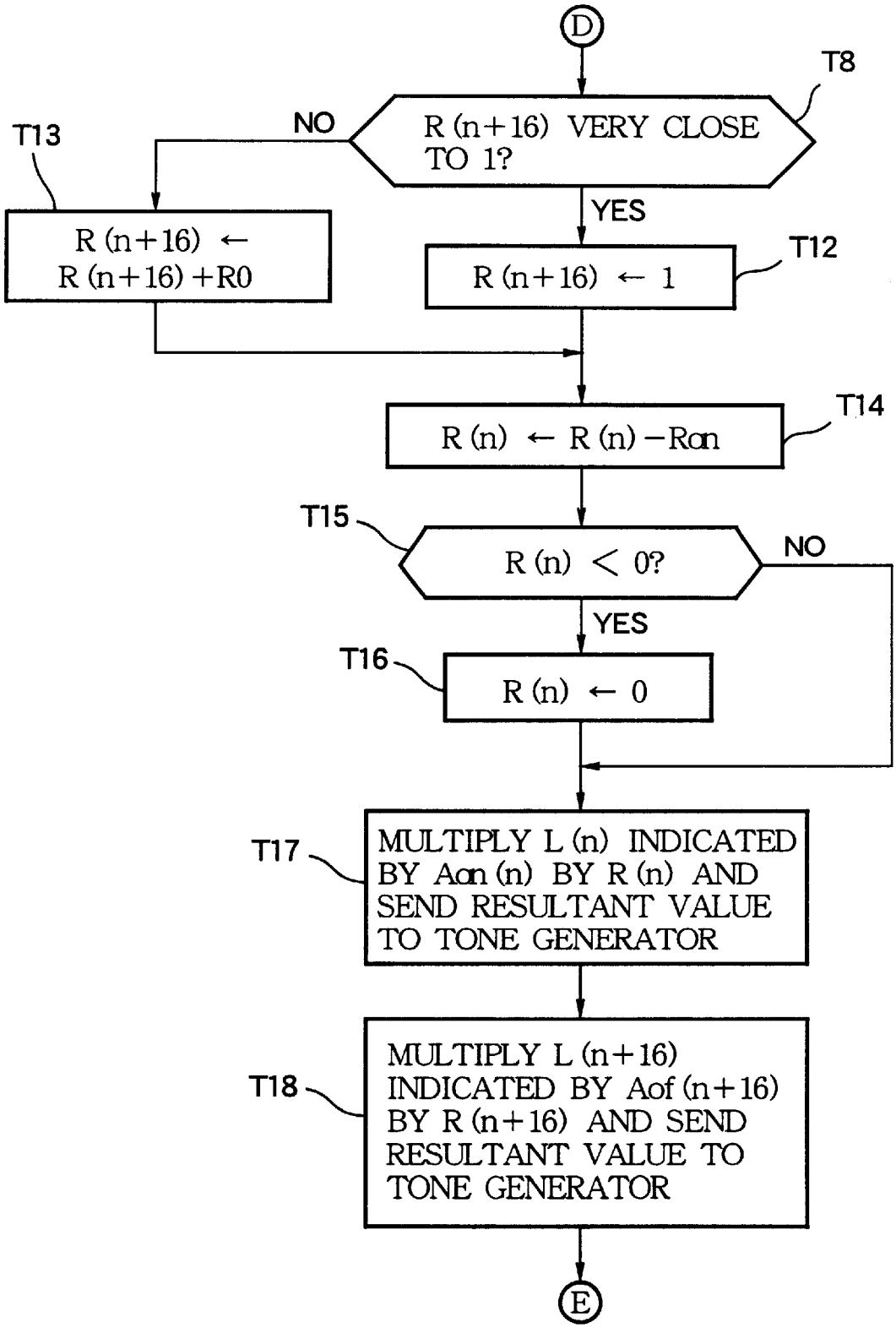
FIG. 14 is a third part (3/4) of the flowchart referred to in FIG. 12.
Figure 15:
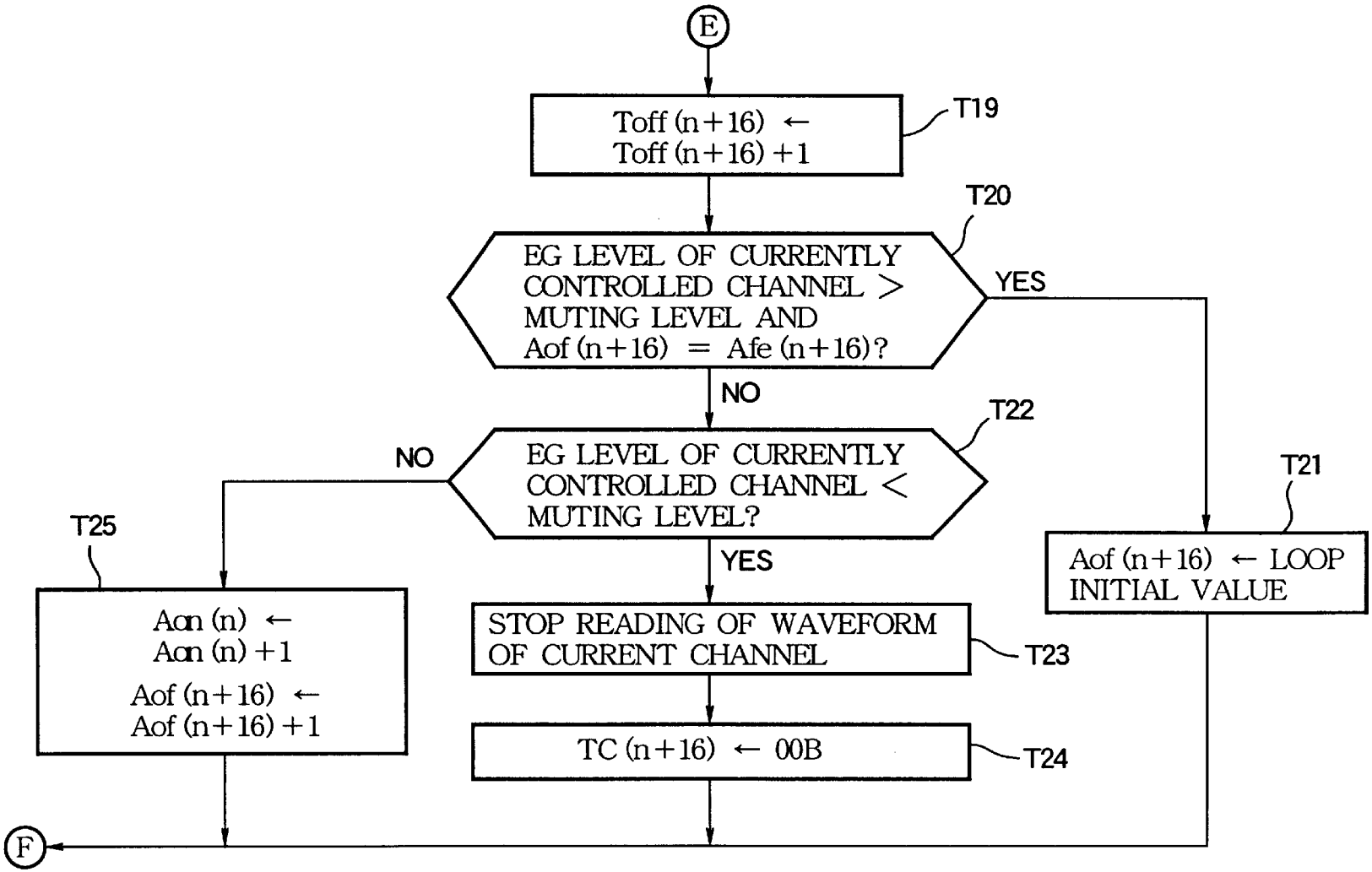
FIG. 15 is a fourth part (4/4) of the flowchart referred to in FIG. 12.

Referring to FIG. 7, there is shown a diagram illustrating key-off waveform reading and controlling operations in the present embodiment. When the key is pressed, a key-on waveform is read with starting from timing t1 at which the second contact "d" of the second switch 48 makes (on) at key position D in the key stroke shown in FIG. 3, thereby generating a leading tone signal in accordance with a key-on velocity Von(n) measured between positions C and D. As will be described, in the present embodiment, a result obtained by multiplying a peak value L(n) shown in FIG. 7 by a value of Von(n) is outputted mainly in step K20 in FIG. 11 and step S8 in FIG. 17. Let the channel number assigned to the key-on waveform be "n", then the channel number for reading the key-off waveform to be processed in the processing flows shown in FIGS. 14 and 15 is "n+16".

For the key-on waveform, when the second contact "d" makes (timing t1) after the making of the first contact "c" of the second switch 48 (timing t0), an initial touch is determined by key-on velocity Von(n) at timing t1 and values obtained by multiplying the peak value data indicated by the waveform address counter with key-on velocity Von(n) are sequentially read out. In terms of rate (R), rate value R=1. If Von(n) itself is determined as a rate, a MIDI equivalent value of the velocity may be a rate. However, the peak value L(n) with the velocity taken into account is considered here. Thus, in order to provide consistency with the later description, the state in which the rate value R=1 is provided as shown in FIG. 7 until the second contact "b" of the first switch 47 breaks.

Figure 10:
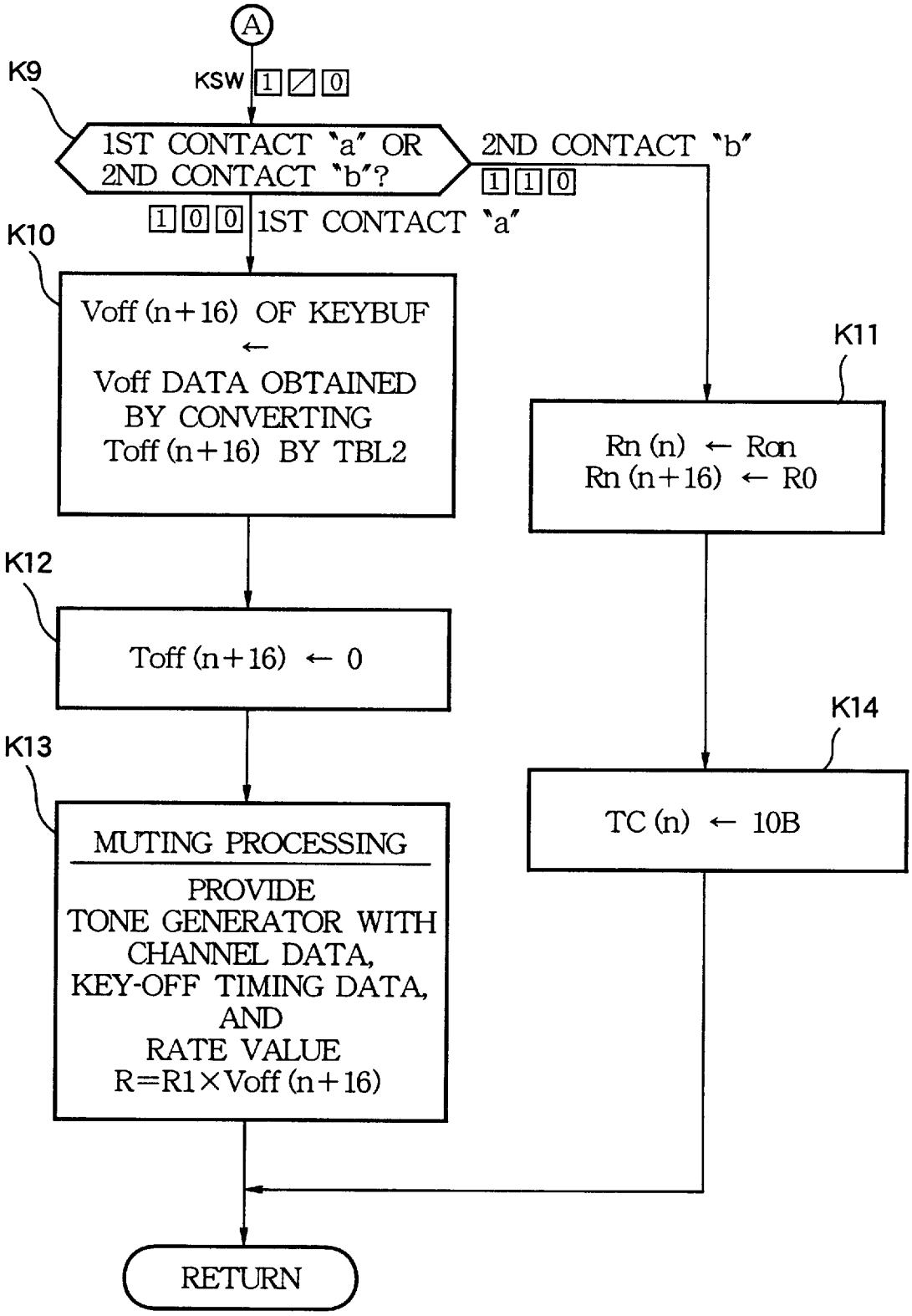
FIG. 10 is a second part (2/3) of the flowchart referred to in FIG. 9.

During the reading of key-on waveform progresses, a key release operation starts, and the break of the second contact "b" of the first switch 47 is detected at timing t2 (refer to step K9 of FIG. 10). Subsequent to timing t2, the key-off waveform is read out. Between timings t2 and t22, both key-on and key-off waveforms are read in a time division manner at the same time, the key-on waveform being faded down at rate R=Ron from timing t2 and the key-off waveform being faded up at rate R=R0, both being mixed in the tone generator 7. This configuration can gradually vary in time not only the transition of the waveforms but also the characteristics (formant or harmonics component) of the waveforms, eventually increasing the dependency on key-off waveform to 100%.

Then, the reading of key-on waveform may be stopped. However, for the simplicity of description, it is assumed that the reading be continued by performing multiplication by rate value R=0 (refer to step T16 of FIG. 14). From timing t22, the inherent peak value of the key-off waveform is read. In order to align the maximum values of the key-on and key-off waveforms, multiplication by initial touch Von is also performed in the reading of the key-off waveform. Next, when the first contact "a" of the first switch 47 breaks at timing t3, the key-off waveform quickly damps at a predetermined decay rate R1. When the key-off waveform is found having almost zero level at timing t4, "all off" is issued. It should be noted that the start portion of the key-off waveform is kept read as it is and the rear portion is read repetitively (namely in a loop). If the key-off stroke is very quick, the reading may be stopped without the repetitive reading.

It should be noted that the sound source for obtaining "key-on waveform" data and "key-off waveform" data may not be a waveform memory as mentioned above. For example, waveforms generated by mathematical approaches such as FM sound source may provide the sound source of the embodiment. Consequently, one piece of waveform data may be obtained from the waveform memory while the other piece of waveform data from the FM sound source. Alternatively, both the waveform data may be obtained from the same sound source. This configuration can realize diversified musical performance expressions. From the point of the realization of key-off tones of fidelity, the sound source of "key-off waveform" data is preferably made of the waveform memory. However, for the simplicity of description, both the key-on and key-off waveform data are obtained from the waveform memory in the following embodiment.

Figure 8:
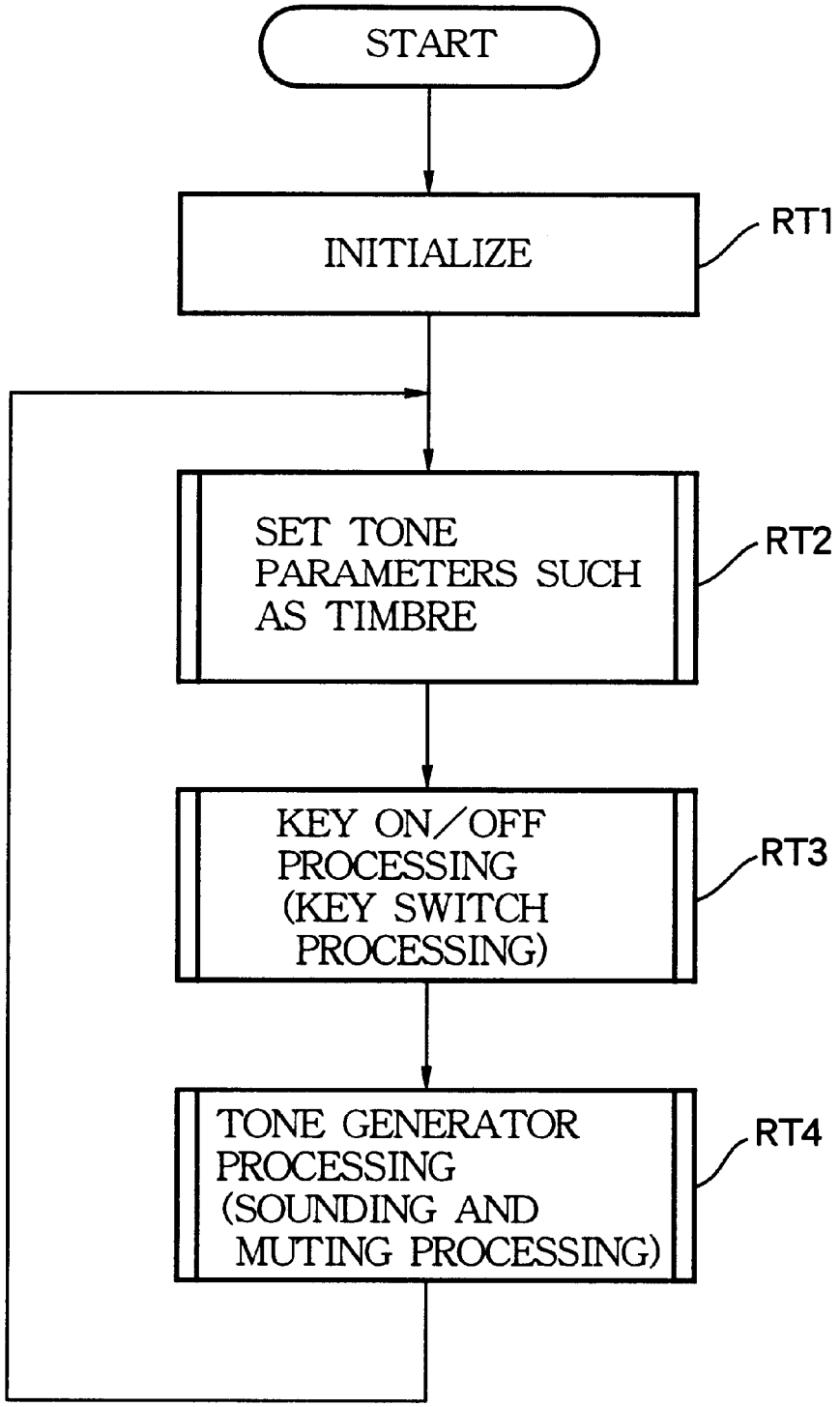
FIG. 8 is a flowchart indicative of main processing in the embodiment of the invention.

Main processing:

Referring to FIG. 8, there is shown a flowchart describing the main processing to be executed in the electronic musical instrument according to the preferred embodiment of the invention. When this processing starts, the key buffer KEYBUF, the switch flag buffer TCBUF, and the counter area in the RAM 3 are initialized by an initializing routine RT1, thereby executing various initializing operations such as the setting of default timbre. In a tone parameter setting routine RT2, the tone parameters specified by the player such as timbre are set to corresponding registers in the tone generator 7.

In a key-on/key-off processing routine RT3, sound/muting control information is generated in accordance with the key pressing or release operation executed by the player on the keyboard 12 and the generated information is sent to the tone generator 7, thereby indicating the execution of sounding/ muting processing. When the sounding/muting processing is executed on the basis of the indication in a tone generator processing routine RT4, the system returns to the tone parameter setting routine RT2 to thereby repeat the processing of the routines RT2 through RT4.

In the electronic musical instrument according the embodiment of the invention, in parallel to this main processing, timer interrupt handling is started in response to a timer interrupt clock generated by the clock generator 9 for each predetermined time (for example, 1 microsecond). This interrupt handling is executed in cooperative association with the key-on/key-off processing, mainly measuring a time between key pressing and key release events, details of which will be described later.

Figure 9:
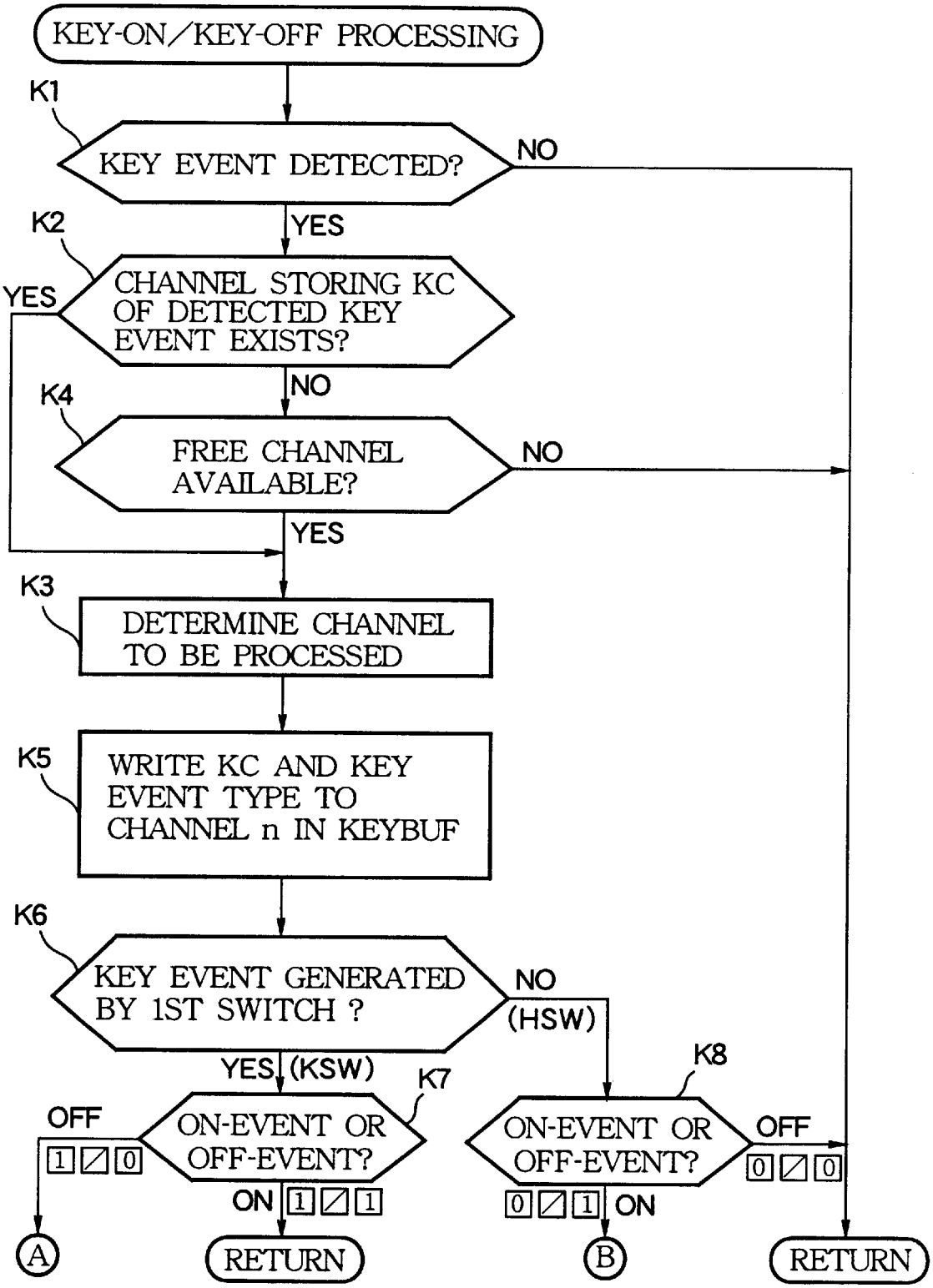
FIG. 9 is a first part (1/3) of a flowchart indicative of key-on and key-off processing according to the embodiment of the invention.
Figure 11:
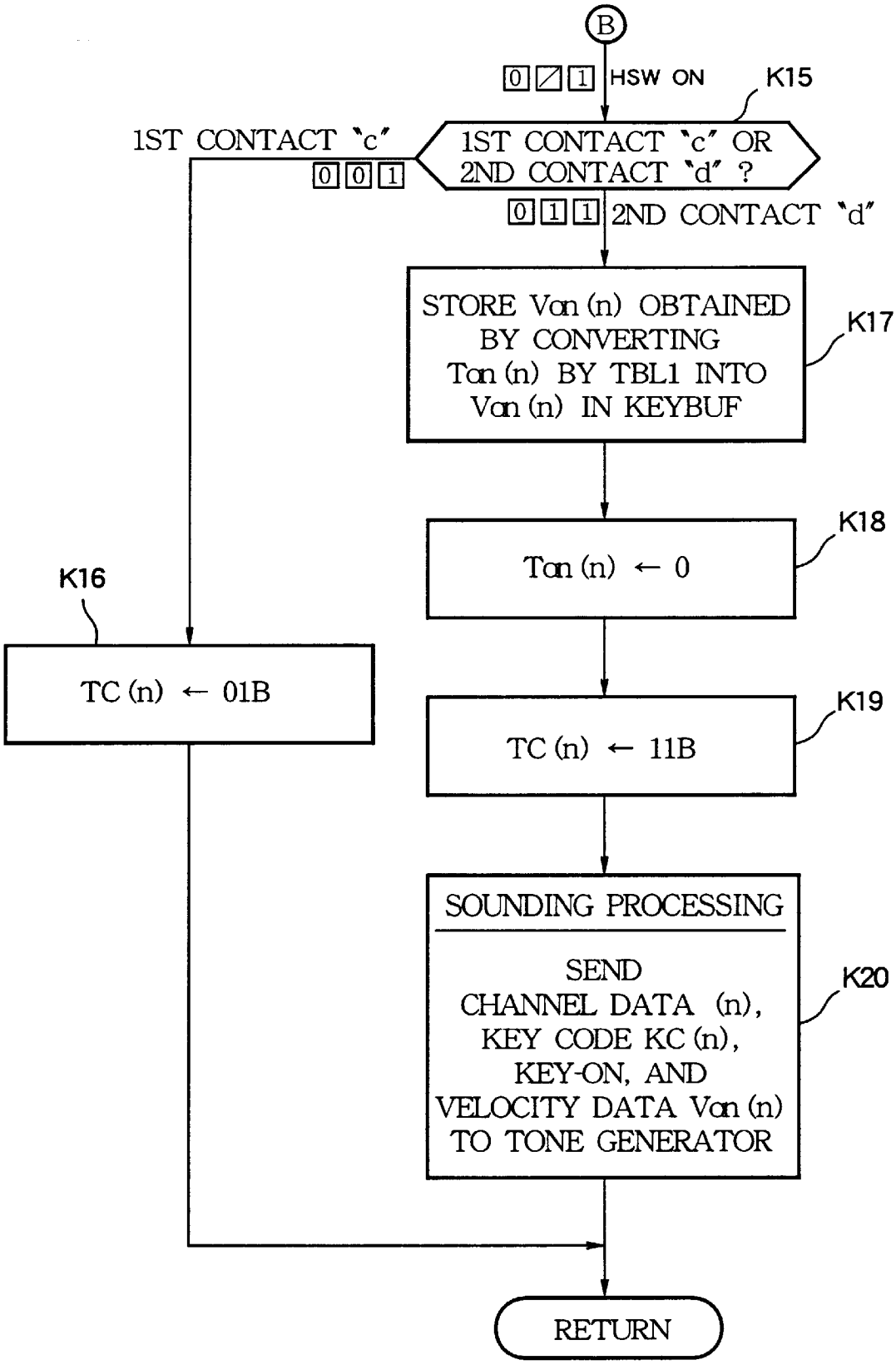
FIG. 11 is a third part (3/3) of the flowchart referred to in FIG. 9.
Figure 12:
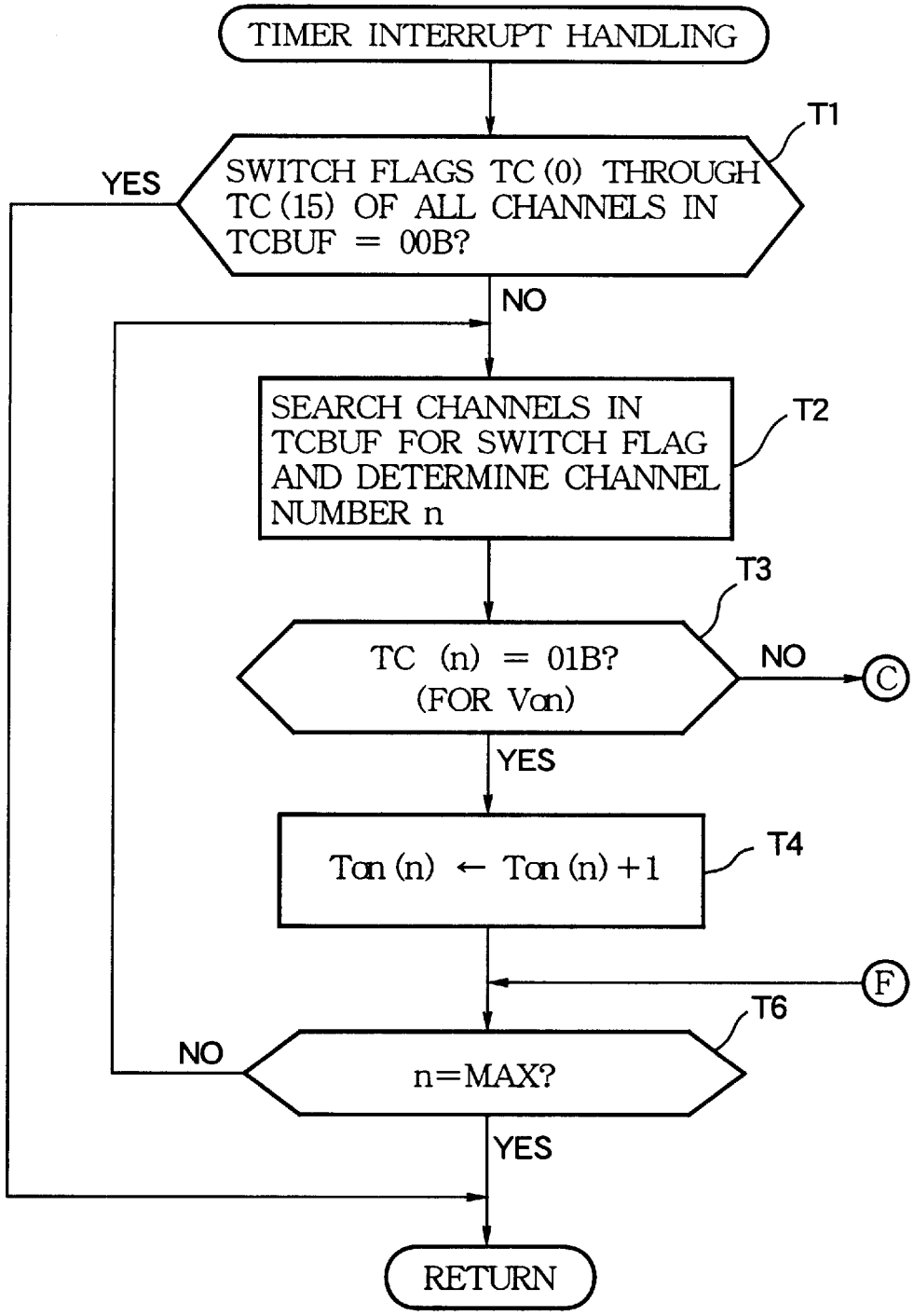
FIG. 12 is a first part (1/4) of a flowchart indicative of timer interrupt handling according to the embodiment of the invention.

Key-on/key-off processing:

FIGS. 9 through 11 are flowcharts indicative of the key-on/key-off processing according to the preferred embodiment of the invention. In the key-on/key-off processing routine RT3 in the main routine shown in FIG. 8, the processing is executed in a following procedure. First, in step K1 (FIG. 9), the routine RT3 determines whether there is any key event. If a key event is found, the routine RT3 proceeds to step K2; otherwise, the routine RT3 immediately returns to the routine RT2. The routine returns because many event have occurred in a short time and therefore many sounding/muting processing operations are being executed, thereby making it impossible to process any newly generated events such as the key event found this time. If the routine returns, the newly found event is ignored.

In step K2, the routine RT3 determines whether there is any channel that stores the key code KC(n) of the key event. If such channel is found, the routine RT3 proceeds to step K3; otherwise, the routine RT3 proceeds to step K4 to check the key buffer KEYBUF in the RAM 3 for a "free channel" in which no key code data KC(n) are stored in the key code region CR. If such a free channel is found, the routine RT3 proceeds to step K3; otherwise the routine RT3 returns immediately.

In step K3, the routine RT3 determines a channel number n to which sounding is allocated. In step K5, the routine RT3 writes the key code KC(n) and key type KV(n) of the generated key event to the key code region CR and key event type region VR corresponding to the determined channel number n in the channel number region NR. Then, the routine RT3 proceeds to step K6.

In step K6, the routine RT3 determines whether the key event is generated by the first switch 47. If the key event is found generated by the first switch 47, the routine RT3 proceeds to step K7; otherwise, the routine RT3 proceeds to step K8.

The following briefly describes the processing flow subsequent to step K8 in the order of the occurrence of events from the generation to the vanishment of a tone, with reference to FIGS. 9 through 11. After the processing which returns from step K8 or K16, if, several tens of milliseconds later, the second contact "d" of the second switch 48 of the same key makes, a tone at the pitch of the pressed key is generated in a processing flow of steps K1 to K2 to K3 to K5 to K6 to K8 to K15 to K17 to K18 to K19 to K20 and return. Then, when the break of the second contact "d" is confirmed, a processing flow of steps K1 through K6 to K8 and return is executed and then, even if the first contact "c" of the second switch 48 breaks, the same processing flow of steps K1 to K8 and return is executed. These two processing flows are substantially ignored.

Next, when the second contact "b" of the first switch 47 breaks, a processing flow of steps K1 through K6 to K9 to K11 to K14 and return is executed. After several tens of milliseconds, which are a contact time difference, the break of the first contact "a" is confirmed. Subsequently, a processing flow of steps K1 through K6 to K9 to K10 through K13 and return is executed, thereby gradually vanishing the tone. Immediately after step K13, a tone trailing for muting is generated for a while, which is then damped quickly, coming to an end of all processing in step S7 shown in FIG. 17 as will be described. Table 1 lists the overall flows of the key-on/key-off detection processing.

TABLE 1

Overall Flow of Key-on/Key-off Detection Processing

| | | |
|---|---|---|
| 1 | a↓ | K6 to K7 and return. |
| 2 | b↓ | K6 to K7 and return. |
| 3 | c↓ | K6 to K8 to K15 to K16 and return: start of key-on velocity measurement to timer interrupt. |
| 4 | d↓ | K6 to K8 to K15 to K17 through K20 and return: end of key-on velocity measurement from timer interrupt. |
| 5 | d↑ | K6 to K8 and return. |
| 6 | c↑ | K6 to K8 and return. |
| 7 | b↑ | K6 to K7 to K9 to K11 to K14 and return. |
| 8 | a↑ | K6 to K7 to K9 to K10 to K12 to K13 and return. |

Note: alphabet letters shown in the second column denote the positions of the contacts "a" through "d" and arrows denote the operation positions and transitional directions of the contacts.

In the case of on-event of the first switch:

If the routine RT3 proceeds to step K7, it determines whether the first contact "a" or the second contact "b" of the first switch 47 made or broke. If the event is found an on-event of the first switch 47 (a tone having the pitch of the pressed key is generated by the processing of key event type data KV(n)="101" or "111"), the routine RT3 returns immediately. If the event is found an off-event of the first switch, the routine RT3 proceeds to step K9 (FIG. 10).

In the case of off-event of the first switch:

In step K9, the routine RT3 further determines whether the contact which gives the off-event of the first switch 47 (by breaking) is the first contact "a" or the second contact "b". If the contact is found the first contact "a", then the routine RT3 proceeds to step K10 to start muting processing. If the contact is found the second contact "b", then the routine RT3 proceeds to step K11. If the detected key event is the off-event of the first contact "a" of the first switch 47 (key event type data KV(n)="100"B), the routine RT3 sequentially executes the processing operations of steps K12 through K15.

In step K10, a key-off velocity value Voff(n+16) obtained by converting an off time value Toff(n+16) counted in the counter area with use of "Toff to Voff conversion" table TBL2 is stored in the key-off velocity region VfR corresponding to channel n in the key buffer KEYBUF. Next, in step K12, the off time value Toff(n+16) in the counter area is reset to zero. In step K13, muting processing is executed and channel data composed of sounding channel data n and key code data KC(n), key-off timing data corresponding to the timing (t3) at which the first contact "a" of the first switch 47 broke, and a value obtained by multiplying damping rate value R="R1" by key-off velocity value Voff (n+16) are sent to the tone generator 7. Then, the routine RT3 returns.

On the other hand, if the second contact "b" of the first switch 47 breaks (key event type data KV(n)="110"B), then, in step K11, rate value R is set to R(n)=Ron, and R(n+16)= R0. Rate value Ron denotes a value for each interrupt indicative of the degree of level down per predetermined time in fading down a key-on waveform. Rate value R0 exists for each interrupt and denotes a level up ratio per predetermined time when fading up a key-off waveform.

Next, in step K15, the switch flag TC(n) is set to "10"B (Toff counting) to start counting the key-off time, upon which the routine RT3 returns.

In the case of off-event of the second switch:

If a key event occurs on the second switch 48, the routine RT3 proceeds from step K6 to step K8 as shown in FIG. 9 and determines whether this key event is an on-event or an off-event, namely, the first contact "c" or the second contact "d" of the second switch 48 made or broke. If the key event is found an on-event, the routine RT3 proceeds to step K15 (FIG. 11); otherwise (key event type data KV(n) "000"B or "010"B), the routine returns immediately.

In the case of on-event of the second switch:

In step K15, the routine RT3 further determines whether the contact which gives the on-event of the second switch 48 (by breaking) is the first contact "c" or the second contact "d". If the first contact "c" of the second switch 48 is found making (key event type data KV(n)="001"B), the routine RT3 proceeds to step K16 and sets "01"B (Ton counting) to the key switch flag TC(n) to start counting the key-on time Ton(n) and then returns.

On the other hand, if the second contact "d" of the second switch 48 is found making (key event type data KV(n)= "011"B), the routine RT3 sequentially executes the processing operations of steps K17 through K20.

In step K17, a key-on velocity value Von(n) obtained by converting an on-time value Ton(n) counted in the counter area with the use of "Ton to Von conversion" table TBL1 is stored in the key-on velocity region VnR corresponding to channel n in the key buffer KEYBUF. Next, in step K18, the on-time value Ton(n) in the counter area is reset to zero. In step K19, the switch flag TC(n) is set to "11"B (to end counting). In step K20, sounding processing is executed and channel data (n), key code data KC(n), key-on timing data, and key-on velocity data Von(n) are sent to the tone generator 7. Then, the routine RT3 returns.

Timer interrupt handling:

FIGS. 12 through 15 are flowcharts indicative of timer interrupt handling according to the preferred embodiment of the invention. In this timer interrupt handling, mainly key-on time Ton(n) or key-off time Toff(n+16) is counted in accordance with a status value of the switch flag TC(n). In the processing flows shown, key-on time Ton(n) is counted in step T4 in a processing flow of steps T1 to T2 to T3 to T4 to T6 to T2. Key-off time is processed as key-off time Toff(n+16) of channel n+16 corresponding to channel n of key-on time Ton(n). Key-off time Toff (n+16)is counted in step T25 in a processing flow of steps T1 to T2 to T3 to T5 to T20 through T25. In addition to the above-mentioned counting processing, processing of sending peak value during sustain (T7, T17, and T18) and processing of setting rate change in waveform transition period (T13 or T14 through T16) are executed in this timer interrupt handling. Table 2 lists details of the flows of the timer interrupt handling. In this table, "many times" in item 4 denotes the number of times corresponding to the number of channels.

TABLE 2

Overall Flows of Timer Interrupt Handling
(Interrupt Every 1 Microsecond)

1. No event — State of TC(n) = 00B
T1→return

TABLE 2-continued

Overall Flows of Timer Interrupt Handling
(Interrupt Every 1 Microsecond)

2. Key-on velocity counting — State of TC(n) = 01B

T1→T2→T3→T4→T6→(after searching all channels)→return

3. After counting key-on velocity — State of TC(n) = 11B
(Immediately after counting key-on velocity, necessary data are acquired in steps K17 through K20 and S8)

T1→T2→T3→T5→T7→T9→T10→T6→return

4. Key-off velocity counting and cross fade in process — State of TC(n) = 10B

T1→T2→T3→T5→T8→T13→T17→ . . . →T20→T22
T6←T25

During repeating this loop many times, L(n) reaches 0 level and N(n + 16) reaches its original level.

T1→T2→T3→T5→T8→T12→T17→ . . . →T20→T22
T6←T25

L(n + 16) progresses at rate = 1.

T1→T2→T3→T5→T8→T12→T17→ . . . →T20→T22
T6←T21 T25

Reading intermediate range of off-waveform

T1→T2→T3→T5→T8→T12→T17→ . . . →T20→T22
T6←T21 T25
T24←T23

When contact "a" breaks, the waveform damps at R = R1.

In step T1 (FIG. 12), an interrupt handling routine determines whether switch flags TC(0) through TC(15) of all channels in the switch flag buffer TCBUF are "00"B. If the decision is YES, the interrupt handling routine immediately returns to the main routine; otherwise, the interrupt handling routine proceeds to step T2. In step T2, the interrupt handling routine checks the switch flag buffer TCBUF for any switch flag that is not "00"B to determine channel numbers n. In this case, the first number n is 1 (or the lowest channel number of the channels having the switch flag that is not "00"B). Namely, the lowest to the highest channel numbers are scanned to extract channels in which switch flag is not "00"B. Various methods are available for this extraction, including one in which timers n are sequentially incremented by 1.

In step T3, the interrupt handling routine determines whether the switch flag TC(n) of the extracted channel n is "01"B. If the switch flag TC(n) is found "01"B (Ton counting), the interrupt handling routine proceeds to step T4 and increments the key-on time count value Ton(n) in the counter area by 1. Otherwise, the interrupt handling routine proceeds to step T5 (FIG. 13).

In step T6, the interrupt handling routine determines whether the current channel number n is the highest channel number value (in this example, 15). If the decision is YES, the interrupt handling routine immediately returns; otherwise, the interrupt handling routine proceeds to step T2, extracts another channel number not including the last channel number value n, and returns to step T3. Namely, in the small loop (T2 to T3 through T6 to T2) shown in FIG.

12, initial touches in which two or more keys have been pressed almost at the same time (simultaneous pressing) are counted. These initial touches are determined when the mode (switch flag) is changed to TC(n)="10"B in step K14 shown in FIG. 10, after the second contact "b" of the first switch 47 has been passed.

Figure 13:
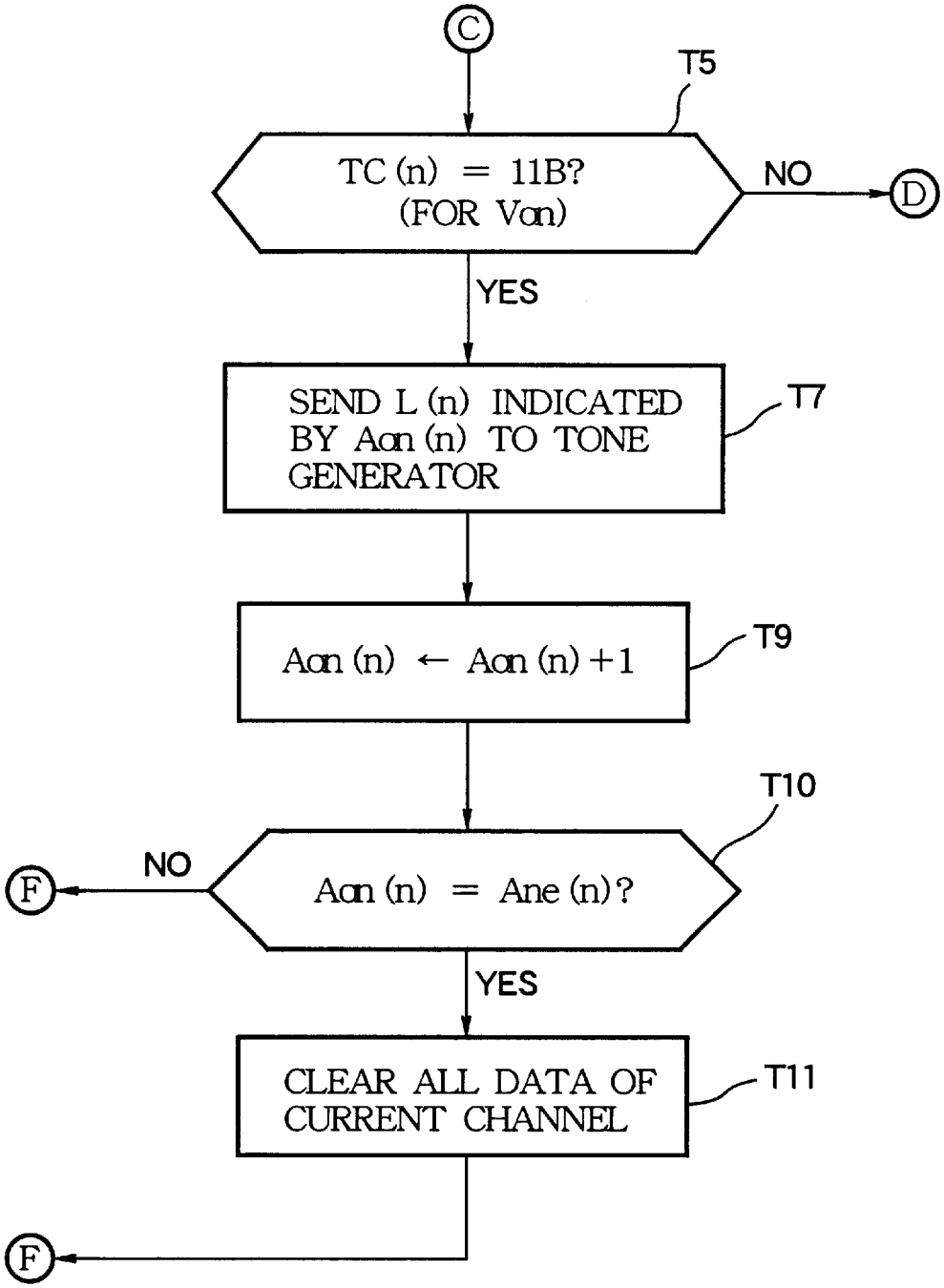
FIG. 13 is a second part (2/4) of the flowchart referred to in FIG. 12.

When the switch flag TC(n) changes from "01"B to "11"B, the interrupt handling routine proceeds from step T1 to T2 to T3 to T5 and determines in step T5 shown in FIG. 13 whether the switch flag TC(n) is "11"B or not. It should be noted that, during the counting of the initial touch of a certain key, the counting of the key-off touch of another key may start. In such a case, a certain channel is processed in step T4 while another channel is processed in step T5. These channels, if the highest channel number n is 16 for example, are processed differently from the processing of channel numbers n=3 and n=4 in the 16 processing operations in the above-mentioned small loop (T2 to T3 through T6 to T2).

If the interrupt routine determines in step T5 during the processing in this small loop that the switch flag TC(n)="11"B (YES), the interrupt handling routine proceeds to step T7; otherwise, the interrupt handling routine proceeds to step T8. In step T7, the interrupt handling routine sends a tone generator peak value L(n) indicated by an address counter register Aon(n) to the tone generator 7. Then, in step T9, the interrupt handling routine increments the address Aon(n) by 1. In step T10, the interrupt handling routine determines if this address Aon(n) is a final value or not. If the address is found not a final value (NO), then the interrupt handling routine proceeds to step T6; otherwise (YES), the interrupt handling routine proceeds to step T11 to clear all data of this channel (n).

Namely, in each step shown in FIG. 13, processing associated with the sound source reading after initial-touch acquisition is mainly executed. In ways of playing with a clipped style such as with staccato (for example, key pressing is immediately followed by key releasing), sustainment of the above-mentioned series of processing states may be very short. The waveform reading is stopped in step S7 shown in FIG. 17.

The following describes timer interrupt processing to be executed when the key is pressed and released with reference to FIGS. 14 and 15. When a key release operation proceeds with the a key-on waveform being sent to the tone generator (FIG. 13), switch flag TC(n)="11"B is set in step K19 shown in FIG. 11, so that this state continues until an off-event of the first contact "a" of the first switch 47 takes place. At this moment, in the timer processing, a processing flow of steps T1 to T2 to T3 to T5 (FIG. 13) through T8 (FIG. 14)is carried out. In step T8, the interrupt handling routine determines whether a value of the timer counter counted in step T19 (FIG. 15) to be described later is higher than a predetermined value (for example, 5 ms). The decision may be "R(n+16)≧1" for example. It should be noted that the rate value R0 in step T13 should become 1 after 5 ms.

If the number n of a channel in processing immediately after the occurrence of the off-event of the second contact "b" of the first switch 47 is 3 for example, a channel in processing having channel number 19 obtained by adding 16 to this 3 is allocated here for the first time. This is because, as seen from FIG. 7, it is necessary to allocate two channels for the key having the same pitch and to proceed simultaneous reading in order to realize cross fading so that no click is generated in transition from key-on waveform to key-off waveform.

Whether key-off time Toff(n+16) in this channel is in a transient state or in a cross-faded state is determined in step T8. If the interrupt handling routine determines that the reading of key-off waveform has started and a predetermined fade-up period (5 ms) has passed, the rate value R(n) almost reaching 1 (the decision is YES), and the interrupt handling routine proceeds to step T12 to fix the rate value R(n+16) to 1.

On the other hand, if the cross-fading is found proceeding in step S6 (the decision is NO), then, in step T13, the predetermined rate value R0 is added every time with the cross-faded rate R(n+16) being R(n+16)+R0. This rate value R0 is a constant for determining the fade up of key-off waveforms. In the present embodiment, a fixed value of $1\times10^{-3}$ to $1\times10^{-4}$ is suitable for the rate value R0 because the interrupt clock is 1 microsecond, although it depends on a interrupt time.

In steps T14 through T16, processing for specifying the rate of the key-on waveform is executed. In step S14, a value obtained by subtracting the predetermined value Ron from the last rate value R(n) is given to rate R(n). If the given rate value R(n) is found in step T15 below zero, then, in step t16, this rate value R(n) is held to zero.

In step T17, with the peak value of a waveform in fade-down of the key-on waveform used as a peak value L(n) indicated by a key-on waveform memory address Aon(n), a value obtained by multiplying the last peak value L(n) by its rate R(n)=Ron (determined in step K11) is sent to the tone generator. Next, in step T18, for the channel n+16, which is the mate channel of the channel n in processing, a peak value L(n+16) indicated by a key-off waveform memory address Aon(n+16) is used as the last peak value x R(n+16). For example, in the proximity of the initial phase of key-off waveform reading, its rate value is set in step T2 to 0.0002 for example, outputting the peak value L(n+16). Initially, this peak value is almost zero, but, just 5 ms later, the rate value becomes 1. Therefore, the rate value Ron is determined in advance as described above so that the rate becomes about 0.2 times the actual peak value 1 ms later, and the rate value at the same point of time in step T17 is determined in advance so that it becomes about 0.8 times the actual peak value 1 ms later.

In step T19 (FIG. 15), the passed time of the channel having number n+16 may only be known, so that key-off time Toff(n+16) is incremented by 1. In step T20, it is determined whether the envelope generator (EG) level of the channel to be currently controlled is above the muting level, or above a level about 40 dB below the maximum level, and an address Aof(n+16) is at its end value Afe(n+16). If the decision is YES in step T20, then the interrupt handling routine proceeds to step T21. If the address is found not incremented and therefore the decision is NO in step T21, then the interrupt handling routine proceeds to step T22.

In step T22, it is determined whether the EG level of the channel to be currently controlled has gone below the muting level. If the waveform is found not fully damped (the decision is NO), the interrupt handling routine proceeds to step T25, in which the routine increments the address counters of addresses Aon(n) and Aof(n+16) by 1 and returns.

When the cross-fading enters the end period, the rate value R(n+16) is fixed to 1 in step T12 as described above. The key-on waveform and the key-off waveform switch through the processing operations of steps T17 and T18. Then, as shown in FIG. 7, when the address counter is incremented to the end address Afe(n+16), the interrupt handling routine proceeds from step T20 to step T21, in which the Aof(n+16) is set to a loop initial value Afs(n+16). Then, when the damping of the key-off waveform progresses, the decision is YES in step T22. In step T23, the waveform reading of this channel is stopped. In step T24, mode TC(n+16) is set to "00"B, upon which the interrupt handling routine returns.

Tone generator processing (sounding/muting processing):

In the preferred embodiment of the invention, the tone waveforms prepared in the tone generator include a key-on waveform and a key-off waveform. For the simplicity of description, the key-on waveform is handled as a waveform obtained by sampling a total waveform generated when a key of a grand piano is kept pressed. To embody this invention into a general product, a partially repeating portion (a loop) may be provided as described with reference to FIG. 7. The key-off waveform is obtained by sampling a tone which damps as a felt member gradually abuts a string at the half releasing of a key of a grand piano. The length of the key-off waveform is particularly about 10 ms to 200 ms, for example. If the output of a longer key-off tone is wanted, a loop may be used as described above.

Figure 16:
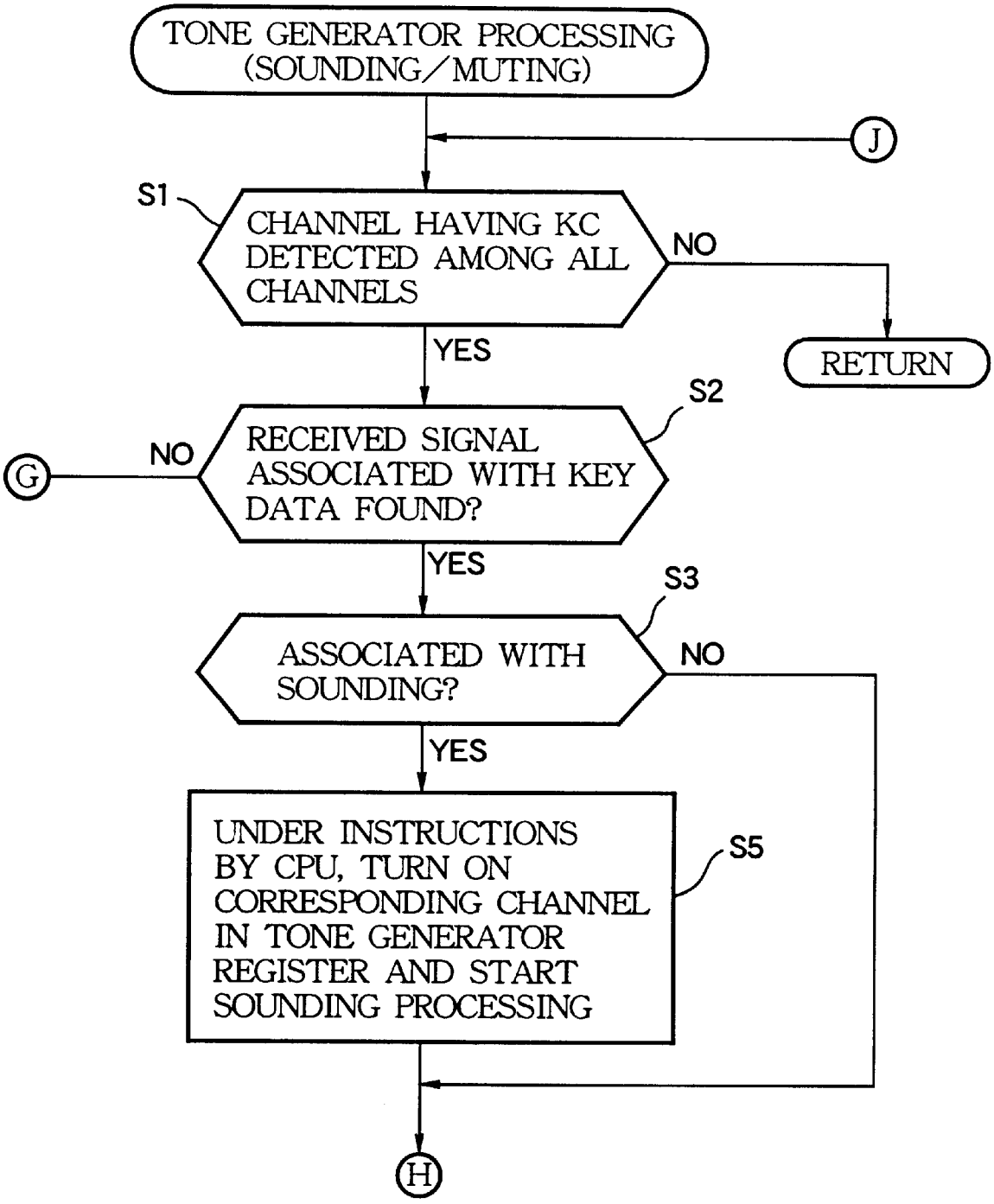
FIG. 16 is a first part (1/2) of a flowchart indicative of tone generation processing (sounding and muting processing) according to the embodiment of the invention.
Figure 17:
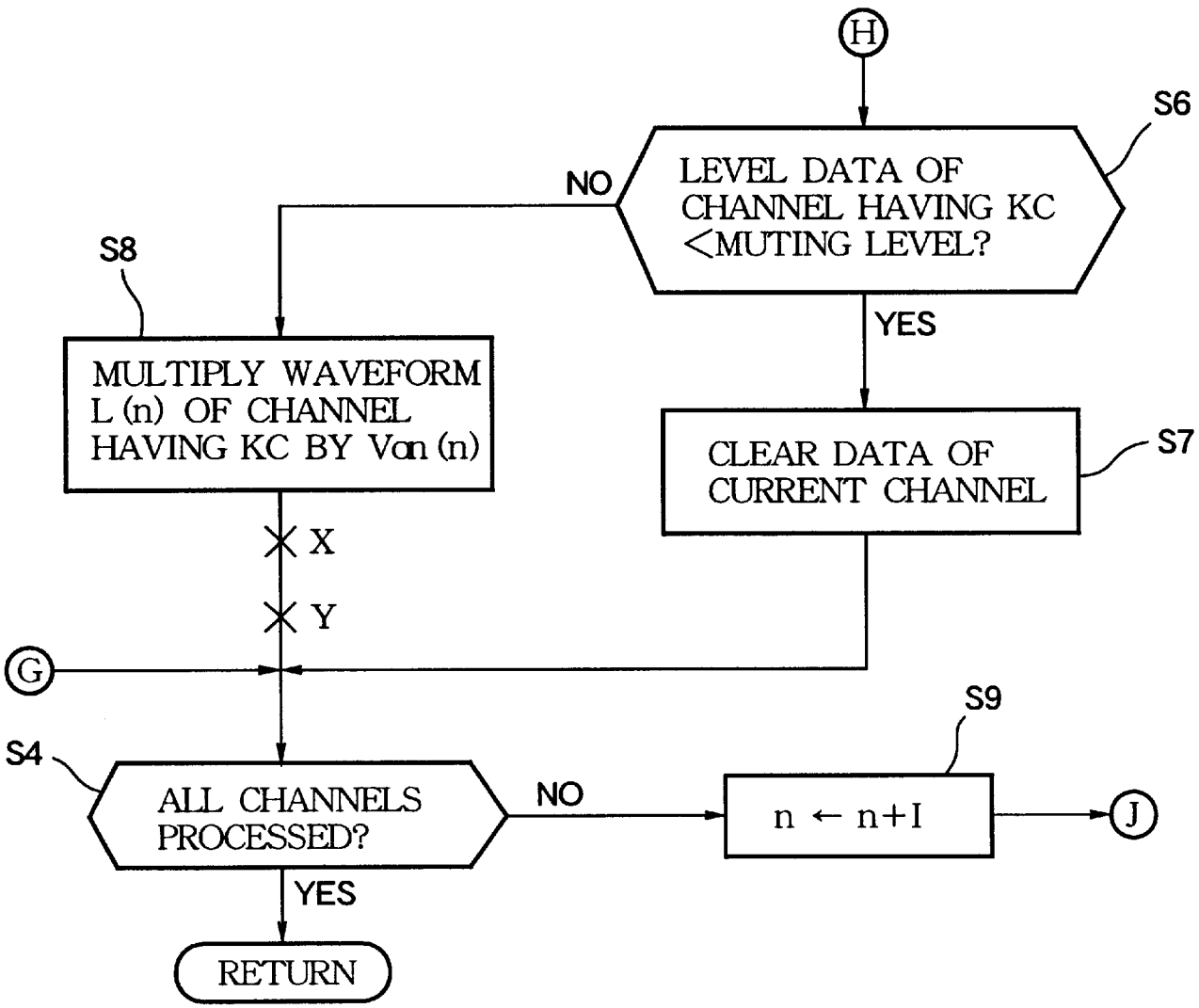
FIG. 17 is a second part (2/2) of the flowchart referred to in FIG. 16.

FIGS. 16 and 17 are flowcharts indicative of tone generator processing (namely, sounding and muting processing) according to the preferred embodiment of the invention. In the main processing shown in FIG. 8, the tone generator processing routine RT4 executes the tone generator processing in the following procedure. It should be noted that the tone generator 7 may be configured by either hardware or software.

In this tone generator processing flow, the following three processing operations are mainly executed.

(1) Sounding processing is executed on the tone generator in a flow of steps S1 to S2 to S3 to S5 to S6 to S8 to S4 and return.

(2) Muting processing is executed on the tone generator in a flow of steps S1 to S2 to S3 to S6 to S8 to S4 and return.

(3) If the EG waveform level of a sounding channel in which a key code KC(n) is stored is below the muting level, all data in the buffers KEYBUF and TCBUF corresponding to that channel and data Ton(n) and Toff(n+16) in the counter area are cleared in a processing flow of steps (S1 to S2 to S3 to S6 to S4) to S7 to S10 to S9 and return.

The tone generator processing herein denotes that the preparation for reading waveforms from the waveform memory ROM incorporated in the tone generator 7 is executed by the CPU 1 beforehand, key-on and key-off velocity data and channel data are temporarily stored in the buffer register 71 (for transfer data to and from the CPU 1), and these stored data are controlled to sound by event data and timer interrupt data.

For example, the present embodiment is configured so as to send various data to the tone generator in step K20 shown in FIG. 11 for key-on waveform reading. However, a tone is not generated immediately thereafter. A tone is generated by scanning the buffer register 71 by 16×2=32 channels and executing the processing shown in FIGS. 16 and 17. The scanning is executed for 32 channels because, when transition is made from a key-on waveform to a key-off waveform, cross fade is applied to each waveform, thereby requiring two channels for one key.

First, in step S1, the tone generator processing routine R4 searches all channels for a channel having key code KC. If the channel having key code KC is found, the routine RT4 proceeds to step S2; otherwise the routine RT4 returns to the main routine. In step S2, the routine RT4 determines whether there is a received signal associated with the key data. If such a signal is found, the routine RT4 proceeds to step S3; otherwise, the routine RT4 skips to step S4 (FIG. 17).

In step S3, the routine RT4 determines whether the received key data are associated with sounding (namely, an on-event). If the key data are found associated with sounding, the routine RT4 turns on the corresponding channel of the tone generator 7 to start sounding processing on the basis of an instruction given by the CPU 1 for starting sounding and then proceeds to step S6 (FIG. 17). Because data other than key-on have been transmitted by the processing shown in FIG. 11, only "on" is transmitted. The number of channel data in this case is 32, which is twice as high as the number of channels described in FIG. 11 with key-off waveform taken into account.

On the other hand, if the received key data are found not associated with sounding, the routine RT4 skips to step S6. In step S6, the routine RT4 determines whether the level data of the channel having key code KC is below a predetermined muting level. If the decision is YES, the routine RT4 clears the data of this channel in step S7 and then proceeds to step S4; otherwise, the routine RT4 proceeds to step S8. In step S8, the routine RT4 multiplies the current peak data L(n) of the channel having key code KC by Von(n) and then proceeds to step S4.

In step S4, the routine RT4 determines whether the above-mentioned processing has been executed on all channels. If the decision is YES, the routine RT4 returns; otherwise, the routine RT4 increments the channel number n by 1 in step S9 and then returns to step S1 to repeat the above-mentioned processing. It should be noted that the channel number n is 0 to 31 and therefore the processing is repeated until 31 is reached.

Figure 18:
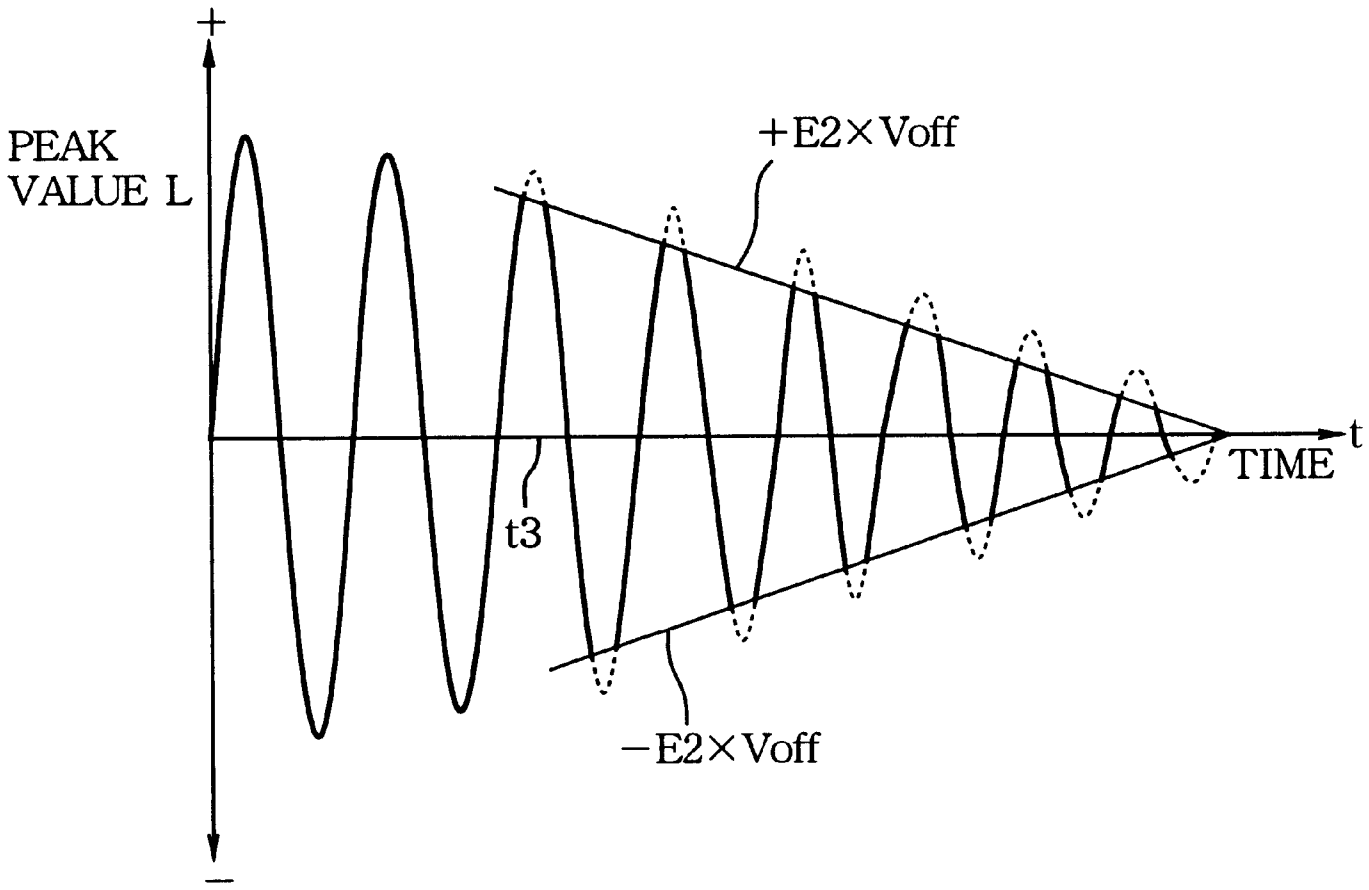
FIG. 18 is a diagram illustrating a method of damping by use of amplitude limitation according to the embodiment of the invention.

Damp processing:

Acoustic instruments such as a piano use a muting member such as a damper felt to damp a tone in muting. The waveform of a tone generated in damping is distorted from the original tone and includes a harmonics wave peculiar to muting. According to the preferred embodiment of the invention, a forced damping effect may be imparted after a key-off section, thereby executing damp processing that effectively simulates such a phenomenon. FIG. 18 illustrates a damping operation of amplitude limiting type (waveform clipping type) according to the embodiment of the invention.

Figure 19:
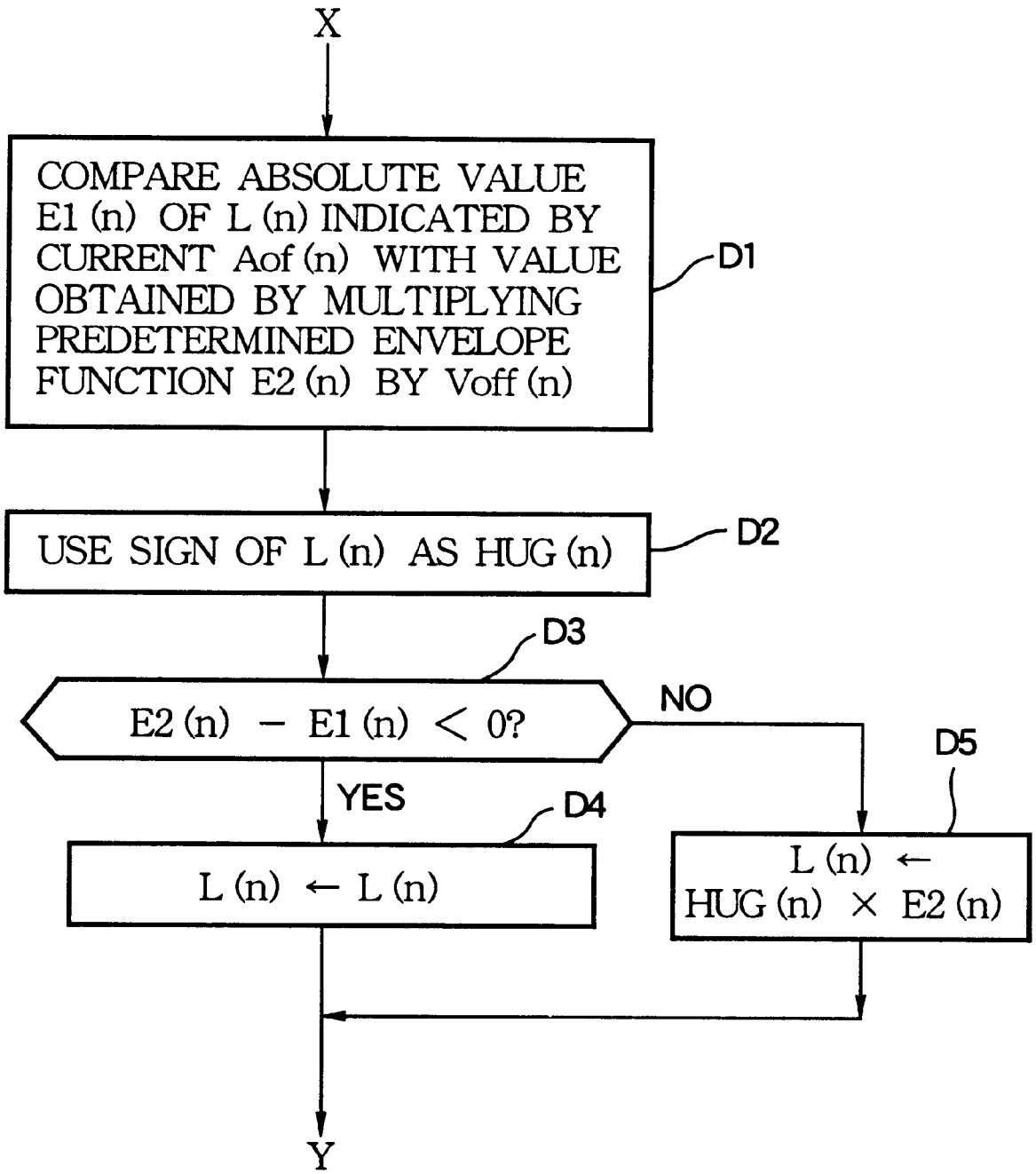
FIG. 19 is a flowchart indicative of damping processing according to the embodiment of the invention.

FIG. 19 is a flowchart for describing damp processing according to the embodiment of the invention. This damp processing flow may be executed at positions X and Y between steps S8 and S4 shown in FIG. 17, for example. Also, it is applicable to a quick muting process after timing t3 at which the first contact "a" of the first switch 47 breaks.

In the first step Dl shown in FIG. 19, in the channel in muting processing with the key status flag TC(n) set to "10"B (where n is 0 to 31), an absolute value E1(n) of current peak value data L(n) indicated by a current key-off waveform memory address Aof(n) is compared with a value obtained by multiplying a predetermined envelope function E2(n) by the key-off velocity. In step D2, the sign ("+1" or "−1") attached to the comparison result is made sign data HUG(n).

In step D3, it is determined whether envelope function E2(n) is smaller than absolute value E1(n). If the E2(n) is found smaller, then, in step D4, current peak value data L(n) of the key-off waveform memory address Aof(n) is directly used as the current peak data L(n). On the other hand, if the E2(n) is found equal to or greater than the function E1(n), then, in step D5, the envelope function E2(n) multiplied by the sign data HUG(n) is used as the current peak value data L(n).

This damp processing uses, as an amplitude limiting value for limiting a tone in the amplitude direction, a value obtained by multiplying the predetermined envelope function E2(n) by a key-off velocity Voff. Because this amplitude limiting value is characterized by gradually decreasing with time as shown in FIG. 18, the damping characteristic of the quickly muting process from application of the damper felt to pressing thereof against a string of an acoustic instrument can be simulated excellently.

Figure 20:
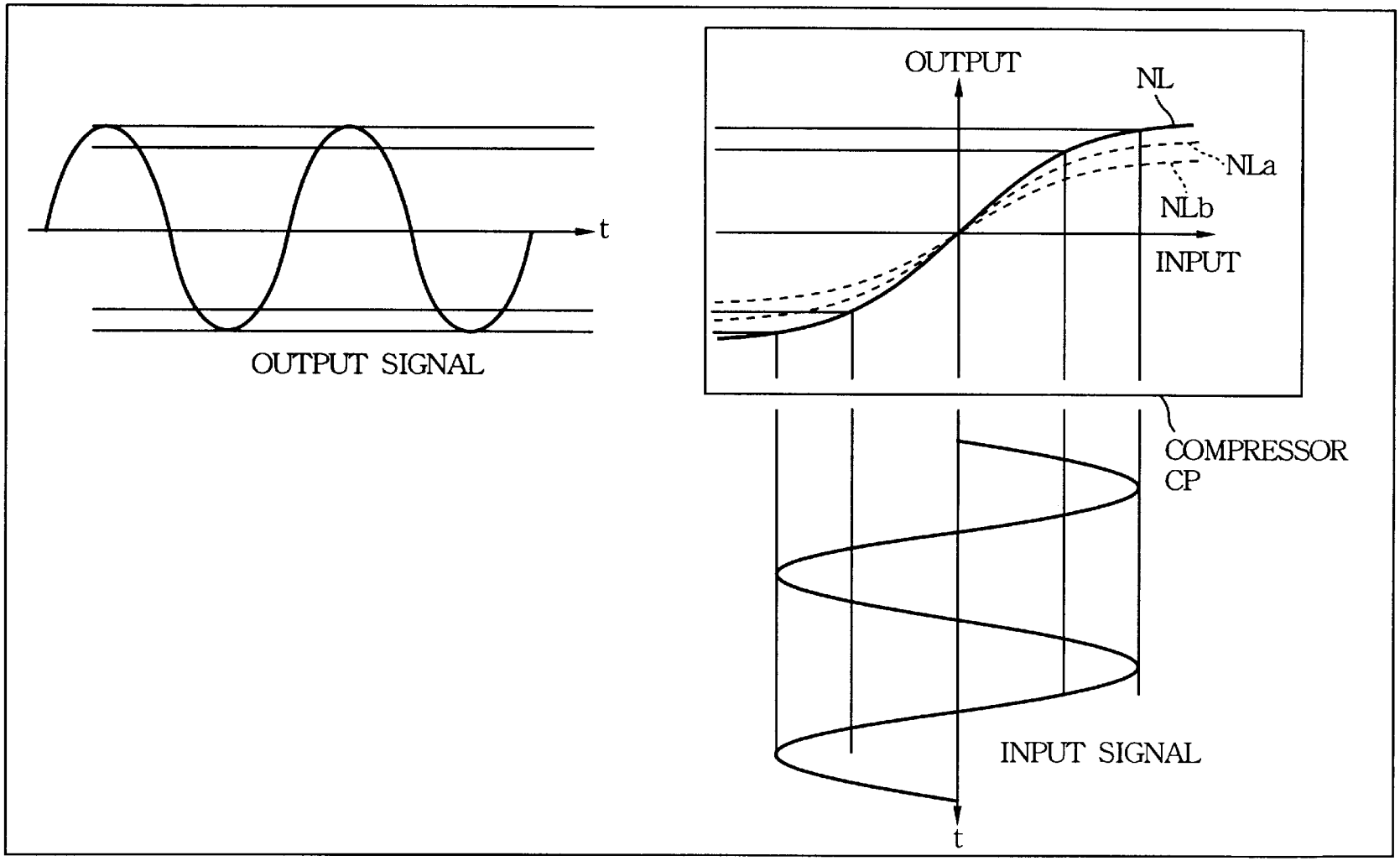
FIG. 20 is a diagram illustrating a method of damping by use of a compressor according to the embodiment of the invention.

The quick damping by limiting tone amplitude can be realized by not only the above-mentioned simple limiter but also a compressor as shown in FIG. 20. In the quick damping by the compressor, a compressor CP is arranged having the input/output characteristic of a nonlinear function NL for lowering an output signal level as an input signal level rises. In the preferred embodiment of the invention, this nonlinear function NL gradually goes flat as time passes as indicated by dashed lines NLa and NLb. Consequently, a tone amplitude can be accordingly limited gradually to a smaller level, thereby excellently simulating the process of quick damping.

Summary of the embodiment:

The following summarizes the operations to be executed at key-on and key-off operations, especially at a key-off operation. Referring to FIG. 7 again, there is shown the time characteristic of the tone generating operation in the electronic musical instrument according to the above-mentioned preferred embodiment of the invention.

Key-on operation for sounding processing:

When a key-on operation is made, the switch flag TC(n) goes "11"B (K19 in FIG. 11) from timing t1 (FIG. 7) at which the second contact "b" of the second switch 48 makes in the key-pressing stroke shown in FIG. 3 to thereby start reading of a key-on waveform (the source of sounding) in the flow of steps T1 to T2 to T3 to T5 to T7 to T9 to T10 to T6 to T2 to T3 to T5 through T6 of the timer interrupt processing (FIGS. 12 through 15).

Key-off operation for muting processing:

When a key-off operation is made, the switch flag TC(n) goes "10"B (K14 in FIG. 10) from timing t2 (FIG. 7) at which the second contact "b" of the first switch 47 has been passed on the off side, namely the second contact "b" breaks in the key-releasing stroke shown in FIG. 3 to thereby start reading the key-on and key-off waveforms in the flow of steps T1 to T2 to T3 to T5 to T8 to T13 (to T12) through T17 to T18 to T19 to T20, the flow of steps T22 to T25 or T21, and the flow of steps T6 to T2 to T3 through T6 in this order. The sounding on the basis of the above-mentioned operations is executed by the processing shown in FIGS. 16 and 17.

The reading of a key-off waveform is triggered by a key-off operation caused by the break of the second contact "b" of the first switch 47 in the key-releasing stroke shown in FIG. 3 as determined in step K9 (FIG. 10) in which the states of the contacts ("a" and "b") are determined in the key-on/key-off processing flow. This processing flow branches to steps K11 and K14.

Namely, when an off-event (break) of the second contact "b" of the second switch 48 takes place, the rate value and the flag are set in steps K11 and K14, respectively. When the flag determination is made in step T5, the flow branches to the processing of step T8 and on. The branch processing (T8 and T12 through T25) simultaneously reads the key-on waveform and the key-off waveform as shown by timings t2 through t22 in FIG. 7. This operation sends the predetermined data into the register of the tone generator 7. In the following cycle, the key-on waveform and the key-off waveform are read from the tone generator 7 in a time division manner to be synthesized, thereby generating a tone in which the key-off waveform is smoothly connected to the key-on waveform.

The reading of the key-off waveform is instructed by the address counter that specifies the address Aof(n+16) of the key-off waveform in step T18 of the timer interrupt processing. In step T20, the end address Afe(n+16) is determined. In step T21, the loop initial value (return address) Afs(n+16) is set.

(1) When the key is released very quickly:

Although it depends on the sampling waveform length stored in the key-off waveform memory, if the key is released very quickly while the stored key-off waveform is long, the key-off section of the first switch 47 is passed at timing t3 shown in FIG. 7 before the end Afe(n) of the waveform is reached (the key-off section is ended by the break of the first contact "a" of the first switch 47). Therefore, key-off velocity Voff(n+16)=Voffa is determined, the break of the first contact "a" is determined in step K9 (FIG. 10), and the processing flow branches to steps TB and on (FIGS. 13 and 14). Because the key-off velocity value Voffa is large, the key-off waveform quickly damps beyond timing t3a at a damping rate R="R1×Voffa".

(2) When the key is released comparatively slowly:

When the key is released in a normal manner, or comparatively slowly, looping is executed in which return is repeated from the end address Afe(n) of the key-off waveform memory to the repetitive address (return address) Afs(n). This looping is executed several times through the processing flow of steps T20 and T21 in which the specification of looping is determined. Namely, this looping is executed because it takes some time to pass the key-off section from the break of the second contact "b" of the first switch 47 to the break of the first contact "a".

If the break event of the first contact "a" of the first switch 47 is passed at timing t3 shown in FIG. 7 for example, a key-off rate is computed in steps K9, K10, K12, and K13, the key-off waveform is read in step S8 and, when the damping level is reached at timing t4, the processing flow branches to step T23 from steps T20 and T22, upon which the reading of the key-off waveform is stopped. Because the key-off velocity Voff(n+16)=Voffb is small in this case (Voffb<Voffa), the damping rate R after timing t3*b* shown in FIG. 7 is "R1×Voffb". Therefore, the waveform damps comparatively slowly. That is, control is made such that the manner of operations of the tone generator (the key-off waveform reading) depends on how the key is released.

Consequently, according to the preferred embodiment of the invention, by slowly passing (or stopping) the subtle intermediate point (between positions B and A), a tone generated by the slight touching of the damper felt to the string (the key-off waveform is generated by sampling this tone) can be sounded in a sustained manner. This tone can be stopped quickly by passing the break event (position A) of the first contact "a" of the first switch 47 at a given timing.

The damping processing may be executed in a manner different from the above. Namely, when the key-off event due to the break of the first contact "a" of the first switch 47 ends (namely, when the second key-off touch information is generated), the supply of the key-off waveform is stopped and, at the same time, the generation of a trailing tone based on the key-off waveform is quickly stopped. To implement this, a looping indication flag Lp(n) indicative of whether to execute looping or not is provided. When the generation of the end of key-off event (the generation of the second key-off touch information) is detected through steps K6 to K8 to K9 of the key-on/off processing, this looping indication flag Lp(n) is reset during steps K9 and K10. In step K13, the damping rate R can be switched from "R1" to "R2" ($0<1/R2<1/R1<1$) to set the key-off velocity to "R2×Voff". Consequently, the tone can be damped almost at the same time as the end of the key-off event (the generation of the second key-off touch information). Namely, the intention of the player for "damping" can be better transmitted to the system.

In one of related-art key-off tone control techniques, a gate time (a time of sustaining a tone) is determined by a key-off velocity (a key-off touch). In this case, a trailing tone (namely a key-off tone) may be sustained after the key is slowly released and the finger departs from the key. To prevent this from happening, the electronic musical instruments are configured so that too long gate times cannot be set. In the present embodiment, the trailing tone can be damped at almost the same time as the releasing of the key as with an acoustic piano. Especially, if a long gate time is set in a key-off operation, the damping processing faithful to the intention of the player can be executed in which slowly releasing the key results in a reasonable gate time and quickly releasing the key results in instant damping.

Referring to FIG. 1 again, an external storage device may be connected to the bus 8. The external storage device may be a HDD (Hard Disk Drive) or any of portable devices such as CD-ROM (Compact Disc Read Only Memory), FD (Floppy Disk), MO (Magneto Optical) disk, and DVD (Digital Versatile Disk). The external storage device can store various control programs and various data in a medium. Therefore, the programs and data necessary for processing the performance data can be stored from the external storage device into the RAM 3, in addition to using the ROM 2.

It should be noted that the bus 8 may be connected to a communications interface such as MIDI interface for mutual communication with another MIDI device and information servers for example, thereby storing control programs and various data into the external storage device from these device and servers. The electronic musical instrument system according to the invention is not limited to one in which the tone generator and the sound system are incorporated in one electronic musical instrument body. Namely, the electronic musical instrument system may be composed of a discrete tone generator and a discrete sound system, which are interconnected by MIDI or various networks.

In addition, the electronic musical instrument system according to the invention may be applied to not only keyboard instruments but also electronic musical instruments of wind instrument type. In the case of wind instrument applications, a tone change with a subtle pitch change can be outputted. This may be effective for a special tone generator key (for example, an instrument which outputs thrum tones by this key) constituted by a switch having a stroke (a certain distance from beginning to end of key pressing). In other words, the electronic musical instrument system according to the invention can be applied to those having a switch that outputs thrum tones by the key having a stroke.

As described above, in the embodiment of the invention, by using the music keyboard apparatus as shown in FIG. 2, the second switch 48 (the second sensor) driven by the mass body 43 detects the key-on information for reading out the key-on music waveform under the key pressing state. The first switch 47 (the first sensor) driven by the key 21W (21B) detects the key-off information to read out the key-off waveform under the key releasing state. By such an operation, the music apparatus can realize an expressive and natural sound system quite similar to the acoustic piano. Such a feature will be described below with comparison to the acoustic piano.

Generally, in the acoustic piano, the striking force is transmitted in the order of a key, a hammer action mechanism, a hammer and a string. At that moment, a damper mechanism operates as a string stopper in link with the key operation. When starting key pressing, a damper felt leaves from a string and is made in contact with the string immediately before the finish of the key release.

In such a sounding/damping mechanism of the piano, the force at the striking of the hammer to the string dominates the musical performance expression, while an intermediate behavior of the key action does not affect the performance expression. However, a mode of the key release or key pressing just after the key release may realize a delicate expression. Namely, the piano is constructed to enable resounding if a jack head returns to a position where the jack head picks up the hammer (the position where the key is slightly released as indicated B of FIG. 3). As the amplitude of the string is great at the time of starting the key release operation, the damper felt operates to slightly suppress the string vibration at the early stage of the key release. At the final stage of the key release operation, the damper felt completely suppresses the string vibration to silence the music tone. Namely, the timbre can be delicately varied according to a technique of the key release. Returning to the embodiment of the invention, inertial information of the mass body 43 having an inertia displaceable along an extended distance is obtained in terms of a key velocity by a contact time difference of the 2-make switch 48 actuated by the mass body 43. Namely, key pressing force form a finger to the key 21 is made in correspondence to the displacement velocity of the key, and the velocity is detected in terms of the mass body velocity at the final stage of the mass body displacement. This operation is similar to the manner by which the force is transmitted from the hammer to the string at the striking of the string. Further, the key-off information is obtained by the switch 47, which detects a release movement of the key having a displacement span (an on/off distance between the pair of the contact) shorter than that of the mass body. Consequently, the switch transition speed per unit time is made moderate as compared to the actuating by he mass body, whereby control by the key-off information at the key release can well reflect the delicate movement of the finger to realistically reproduce the music sound control. Namely, in case of controlling for determining a key position in switching to a musical tone of a string in half contact with the damper felt, a natural expression can be obtained comparative to the acoustic piano. Stated otherwise, only unnatural expression would be obtained if the switches actuated by the key 21W (21B) alone or by the mass body 43 alone are used.

Further, in the embodiment, resounding is enabled without strong key release operation, while the complete muting is achieved by the strong key release in matching with the principle of the acoustic piano.

In short, the timing for starting the reading of the key-off waveform should be determined in terms of the key position as in the acoustic piano. Namely, a piano player physically recognizes that the damper effect starts to work when the key is placed at a relatively shallow position relative to the complete key release position. On the other hand, in the sounding and resounding of the tone, the force of the finger acting on the key or equivalent factor should be reflected on the control and generation of the musical tone, as in the actual case of the acoustic piano. Namely, once a significant force is applied to the key at a great initial key velocity, then the force is well transmitted to the hammer that hits the string and the mass body actuates the second sensor.

In the embodiment of the invention, the second sensor 48 is turned on as the initial key velocity is great even if the mass body driver WA of the key 21 and the torque transmitting portion 44 separate from each other during the key pressing operation, in manner similar to the acoustic piano. In the embodiment, the second sensor 48 is a touch response switch such that the initial force corresponds to the touch response. In the resounding mechanism of the embodiment, as shown in FIG. 3, the resounding is enabled when the key 21 or the mass body 43 is displaced to a level shallower than the contact c of the second sensor 48. Consequently, the resounding during the current sounding is realized likewise the resounding function of the acoustic piano although details of the resounding mechanism of the invention is different from that of the acoustic piano.

As described and according to the invention, tone key-off control is executed in two stages. Consequently, the embodied system can faithfully respond to a key-off operation by the player and stop the key-off trailing tone almost at the same time as the player detaches the finger from a play control.

Further, as described and according to the invention, the key-off sound source (the second sound source) is arranged separately from the key-on sound source (the first sound source) and the key-off sound source is generated in response to a key-off touch and the sustaining tone of the second sound source is controlled. Consequently, a music performance tone to be keyed off can be controlled as desired by the player; especially, even a long sustained key-off tone can be vanished as desired by the player.

According to the still further aspect of the invention, the key-on waveform is read out in response to an on-event of the second sensor which is actuated by the mass body having a pivot span greater than that of the key during a latter part of the forward key stroke, while the key-off waveform is read out in response to an off-event of the first sensor actuated by the key during a first half part of the key stroke, thereby realizing the expressive and natural sound system very similar to that of the acoustic piano.

While the preferred embodiments of the present invention have been described using specific terms, such description is for illustrative purposes only, and it is to be understood that changes and variations may be made without departing from the spirit or scope of the appended claims.

What is claimed is:

1. An electronic musical apparatus having a generator for generating a tone, comprising:

a play member provided for playing a music such that a key-on touch operation and a key-off touch operation are performed on the play member to input a note of the music; a detector that detects the key-on touch operation and the key-off touch operation to generate key-on information and key-off information; and a controller operative based on the key-on information and the key-off information for controlling the generator to generate a tone corresponding to the note, wherein the detector detects a transitional state of the key-off touch operation for generating a sequence of first key-off information and second key-off information indicative of the transitional state of the key-off touch operation, and the controller responds to the first key-off information for controlling the generator to start generating of a trailing tone of the note and responds to the second key-off information for controlling the generator to stop generating of the trailing tone of the note.

2. The electronic musical apparatus according to claim 1, wherein the generator has a memory storing a waveform representing the trailing tone, so that the controller controls the generator to read out the waveform from the memory for generating the trailing tone in response to the first key-off information.

3. The electronic musical apparatus according to claim 2, wherein the memory stores a waveform sampled from a trailing tone of an acoustic piano.

4. The electronic musical apparatus according to claim 2 wherein the controller controls the generator to loop the reading of the waveform so as to continue generating of the trailing tone until the detector generates the second key-off information.

5. The electronic musical apparatus according to claim 1, wherein the controller controls the generator to forcibly damp the trailing tone in response to the second key-off information.

6. The electronic musical apparatus according to claim 1, wherein the controller calculates a velocity of the key-off touch operation according to the first key-off information and the second key-off information, and controls the generator to set a decay rate of the trailing tone according to the velocity.

7. The electronic musical apparatus according to claim 1, wherein the controller responds to the key-on information for controlling the generator to generate a leading tone of the note, which is then changed to a trailing tone of the same note in response to the first key-off information.

8. The electronic musical apparatus according to claim 7, wherein the controller controls the generator to fade out the leading tone and to fade in the trailing tone in response to the first key-off information.

9. The electronic musical apparatus according to claim 7, wherein the generator has one source dedicated for generating the leading tone and another source separate from the one source for generating the trailing tone, such that the leading tone and the trailing tone have different timbres.

10. An electronic musical apparatus having a generator for generating a tone, comprising:

a play member provided for playing a music such that a key-on touch operation and a key-off touch operation are performed on the play member to input a note of the music;

a detector that detects the key-on touch operation and the key-off touch operation to generate key-on information and key-off information, wherein the detector detects a transitional state of the key-off touch operation for generating a sequence of first key-off information and second key-off information indicative of the transitional state of the key-off touch operation; and a controller operative based on the key-on information for controlling the generator to generate a leading tone of the note, the controller further being responsive to the first key-off information for controlling the generator to start generating of a trailing tone of the note and being responsive to the second key-off information for controlling the generator to stop generating of the trailing tone of the note.

11. An electronic musical apparatus having a generator for generating a tone, comprising:

a play member provided for playing a music such that a key-on touch operation and a key-off touch operation are performed on the play member to input a note of the music;

a detector that detects the key-on touch operation and the key-off touch operation to generate key-on information and key-off information, wherein the detector detects a transitional state of the key-on touch operation for generating a sequence of first key-on information and second key-on information indicative of a time-variation of the key-on touch operation, and detects another transitional state of the key-off touch operation for generating a sequence of first key-off information and second key-off information indicative of the transitional state of the key-off touch operation; and a controller operative based on the first key-on information and the second key-on information for controlling the generator to generate a leading tone of the note, the controller further being responsive to the first key-off information for controlling the generator to start generating of a trailing tone of the note and being responsive to the second key-off information for controlling the generator to stop generating of the trailing tone of the note.

12. An electronic musical apparatus comprising:

a play member provided for playing a music such that a key-on touch operation and a key-off touch operation are performed on the play member to input a note of the music; a detector that detects the key-on touch operation and the key-off touch operation to generate key-on information and key-off information; a generator controllable for generating a tone; and a controller operative based on the key-on information and the key-off information for controlling the generator to generate a tone associated to the note, wherein the detector detects a transitional state of the key-off touch operation for generating a sequence of first key-off information and second key-off information indicative of the transitional state of the key-off touch operation, the generator has a memory storing a waveform representing a tone corresponding to the key-off touch operation, and the controller controls the generator for reading out the waveform from the memory in response to the first key-off information to start generating of the tone corresponding to the key-off touch operation, and controls the generator to stop generating of the tone corresponding to the key-off touch operation in response to the second key-off information.

13. An electronic musical apparatus comprising:

a play member provided for playing a music such that a key-on touch operation and a key-off touch operation are performed on the play member to input a note of the music;

a detector that detects the key-on touch operation and the key-off touch operation to generate key-on information and key-off information, wherein the detector detects a transitional state of the key-off touch operation for generating a sequence of first key-off information and second key-off information indicative of the transitional state of the key-off touch operation;

a generator controllable for generating a tone and having a memory storing a leading waveform of the tone corresponding to the key-on touch operation and a trailing waveform of the tone corresponding to the key-off touch operation; and a controller operative based on the key-on information and the key-off information for controlling the generator to generate the tone associated to the note, wherein the controller controls the generator for reading out the leading waveform from the memory in response to the key-on information, and the controller controls the generator to start reading of the trailing waveform from the memory in response to the first key-off information and to stop reading of the trailing waveform in response to the second key-off information.

14. An electronic musical apparatus comprising:

a play member provided for playing a music such that a key-on touch operation and a key-off touch operation are performed on the play member to input a note of the music;

a detector that detects the key-on touch operation and the key-off touch operation to generate key-on information and key-off information, wherein the detector detects a transitional state of the key-on touch operation for generating a sequence of first key-on information and second key-on information indicative of a time-variation of the key-on touch operation, and further detects another transitional state of the key-off touch operation for generating a sequence of first key-off information and second key-off information indicative of the transitional state of the key-off touch operation;

a generator controllable for generating a tone and having a memory storing a leading waveform of the tone corresponding to the key-on touch operation and a trailing waveform of the tone corresponding to the key-off touch operation; and a controller operative based on the key-on information and the key-off information for controlling the generator to generate the tone associated to the note, wherein the controller controls the generator for reading out the leading waveform from the memory according to the first key-on information and the second key-on information, and the controller further controls the generator to start reading of the trailing waveform from the memory in response to the first key-off information and to stop reading of the trailing waveform in response to the second key-off information.

15. An electronic musical apparatus comprising:

a play member provided for playing a music such that a key-on touch operation and a key-off touch operation are performed on the play member to input a note of the music;

a detector that detects the key-on touch operation to output key-on information and that detects the key-off touch operation to output key-off information;

a generator that has a first sound source for generating a first tone and a second sound source for generating a second tone; and a controller operative based on the key-on information for controlling the generator to generate the first tone from the first sound source, and operative based on the key-off information for controlling the generator to generate the second tone from the second sound source, the controller further controlling the generator to regulate a duration of the second tone according to the key-off information.

16. An electronic musical apparatus comprising:

a key member provided for performing a key-on touch operation in a forward stroke and a key-off touch operation in a return stroke so as to input a music note;

a mass member linked to the key member to undergo a forward stroke in response to the forward stroke of the key member for imparting a weight to the key-on touch operation, and to undergo a return stroke in response to the return stroke of the key member, wherein the mass member has a stroke span set greater than a stroke span of the key member;

a detector that has a first sensor for detecting the forward stroke and the return stroke of the key member to output key-off information in response to the key-off touch operation, and a second sensor for detecting the forward stroke and the return stroke of the mass member to output key-on information in response to the key-on touch operation;

a generator that has a first sound source for generating a leading tone of the music note and a second sound source for generating a trailing tone of the music note; and a controller operative based on the key-on information outputted from the second sensor for controlling the generator to generate the leading tone from the first sound source, and being operative based on the key-off information outputted from the first sensor for controlling the generator to generate the trailing tone from the second sound source.

17. The electronic musical apparatus according to claim 16, wherein the second sensor has a pair of contact switches sequentially actuateable by the mass member to detect a velocity of the mass member.

18. The electronic musical apparatus according to claim 16, wherein the first sensor has a switch sequentially actuateable by the key member to detect a velocity of the key member.

19. An electronic musical apparatus comprising:

a key member provided for performing a key-on touch operation in a forward stroke and a key-off touch operation in a return stroke so as to input a music note;

a mass member linked to the key member to undergo a forward stroke in response to the forward stroke of the key member for imparting a weight to the key-on touch operation, and to undergo a return stroke in response to the return stroke of the key member, wherein the mass member has a stroke span set greater than a stroke span of the key member;

a detector that has a first sensor for detecting when the key member advances the return stroke in response to the key-off touch operation so as to output key-off information, and a second sensor for detecting when the mass member advances the forward stroke in response to the key-on touch operation so as to output key-on information;

a generator that has a first sound source for generating a leading tone of the music note and a second sound source for generating a trailing tone of the music note; and a controller operative based on the key-on information outputted from the second sensor for controlling the generator to generate the leading tone from the first sound source, and being operative based on the key-off information outputted from the first sensor for controlling the generator to generate the trailing tone from the second sound source.

20. A method of generating a tone in an electronic musical apparatus having a play member and a tone generator, the method comprising the steps of:

operating the play member in playing a music such that a key-on touch operation and a key-off touch operation are performed on the play member to input a note of the music;

detecting the key-on touch operation and the key-off touch operation to generate key-on information and key-off information; and controlling the tone generator to generate a tone corresponding to the note based on the key-on information and the key-off information, wherein p1 the step of detecting detects a transitional state of the key-off touch operation for generating a sequence of first key-off information and second key-off information indicative of the transitional state of the key-off touch operation, and the step of controlling responds to the first key-off information for controlling the tone generator to start generating of a trailing tone of the note, and responds to the second key-off information for controlling the tone generator to stop generating of the trailing tone of the note.

21. A method of generating a tone in an electronic musical apparatus having a play member and a tone generator, the method comprising the steps of:

operating the play member in playing a music such that a key-on touch operation and a key-off touch operation are performed on the play member to input a note of the music;

detecting the key-on touch operation and the key-off touch operation to generate key-on information and key-off information, wherein the step of detecting further detects a transitional state of the key-off touch operation for generating a sequence of first key-off information and second key-off information indicative of the transitional state of the key-off touch operation; and controlling the tone generator to generate a tone corresponding to the note based on the key-on information and the key-off information, wherein the step of controlling responds to the key-on information for controlling the tone generator to generate a leading tone of the note, and the step of controlling further responds to the first key-off information for controlling the tone generator to start generating of a trailing tone of the note and responds to the second key-off information for controlling the tone generator to stop generating of the trailing tone of the note.

22. A method of generating a tone in an electronic musical apparatus having a play member and a tone generator, the method comprising the steps of:

operating the play member in playing a music such that a key-on touch operation and a key-off touch operation are performed on the play member to input a note of the music;

detecting the key-on touch operation and the key-off touch operation to generate key-on information and key-off information, wherein the step of detecting further detects a transitional state of the key-on touch operation for generating a sequence of first key-on information and second key-on information indicative of a time-variation of the key-on touch operation, and detects another transitional state of the key-off touch operation for generating a sequence of first key-off information and second key-off information indicative of the transitional state of the key-off touch operation; and controlling the tone generator to generate a tone corresponding to the note based on the key-on information and the key-off information, wherein the step of controlling responds to the first key-on information and the second key-on information for controlling the tone generator to generate a leading tone of the note, and the step of controlling further responds to the first key-off information for controlling the tone generator to start generating of a trailing tone of the note and responds to the second key-off information for controlling the tone generator to stop generating of the trailing tone of the note.

23. A method of generating a tone in an electronic musical apparatus having a play member, a tone generator and a waveform memory, the method comprising the steps of:

operating the play member in playing a music such that a key-on touch operation and a key-off touch operation are performed on the play member to input a note of the music;

detecting the key-on touch operation and the key-off touch operation to output key-on information and key-off information; and controlling the tone generator to generate a tone associated to the note based on the key-on information and the key-off information, wherein the step of detecting detects a transitional state of the key-off touch operation for outputting a sequence of first key-off information and second key-off information indicative of the transitional state of the key-off touch operation, and the step of controlling controls the tone generator for reading out a waveform representing a tone corresponding to the key-off touch operation from the waveform memory in response to the first key-off information to start generating of the tone corresponding to the key-off touch operation, and controls the tone generator to stop generating of the tone corresponding to the key-off touch operation in response to the second key-off information.

24. A method of generating a tone in an electronic musical apparatus having a play member, a tone generator and a waveform memory, the method comprising the steps of:

operating the play member in playing a music such that a key-on touch operation and a key-off touch operation are performed on the play member to input a note of the music;

detecting the key-on touch operation and the key-off touch operation to output key-on information and key-off information, wherein the step of detecting detects a transitional state of the key-off touch operation for outputting a sequence of first key-off information and second key-off information indicative of the transitional state of the key-off touch operation; and controlling the tone generator to generate a tone associated to the note based on the key-on information and the key-off information, wherein the step of controlling controls the tone generator for reading out a leading waveform of the tone from the waveform memory in response to the key-on information, and the step of controlling further controls the tone generator to start reading of a trailing waveform of the tone from the waveform memory in response to the first key-off information, and to stop reading of the trailing waveform in response to the second key-off information.

25. A method of generating a tone in an electronic musical apparatus having a play member, a tone generator and a waveform memory, the method comprising the steps of:

operating the play member in playing a music such that a key-on touch operation and a key-off touch operation are performed on the play member to input a note of the music;

detecting the key-on touch operation and the key-off touch operation to output key-on information and key-off information, wherein the step of detecting detects a transitional state of the key-on touch operation for outputting a sequence of first key-on information and second key-on information indicative of a time-variation of the key-on touch operation, and further detects another transitional state of the key-off touch operation for outputting a sequence of first key-off information and second key-off information indicative of the transitional state of the key-off touch operation; and controlling the tone generator to generate a tone associated to the note based on the key-on information and the key-off information, wherein the step of controlling controls the tone generator for reading out a leading waveform of the tone from the waveform memory according to the first key-on information and the second key-on information, and the step of controlling further controls the tone generator to start reading of a trailing waveform of the tone from the waveform memory in response to the first key-off information, and to stop reading of the trailing waveform in response to the second key-off information.

26. A method of generating a tone in an electronic musical apparatus having a play member and a tone generator containing a first sound source for generating a first tone and a second sound source for generating a second tone, the method comprising the steps of:

operating the play member for playing a music such that a key-on touch operation and a key-off touch operation are performed on the play member to input a note of the music;

detecting the key-on touch operation to output key-on information and detecting the key-off touch operation to output key-off information;

controlling the tone generator to generate the first tone from the first sound source based on the key-on information;

controlling the tone generator to generate the second tone from the second sound source based on the key-off information; and controlling the tone generator to regulate a duration of the second tone according to the key-off information.

27. A method of generating a tone in an electronic musical apparatus having a key member, a mass member and a tone generator containing a first sound source for generating a leading tone and a second sound source for generating a trailing tone, the method comprising the steps of:

operating the key member for performing a key-on touch operation in a forward stroke and a key-off touch operation in a return stroke so as to input a music note;

operating the mass member linked to the key member to undergo a forward stroke in response to the forward stroke of the key member for imparting a weight to the key-on touch operation, and to undergo a return stroke in response to the return stroke of the key member, wherein the mass member has a stroke span set greater than a stroke span of the key member;

detecting the forward stroke and the return stroke of the key member by a first sensor to output key-off information in response to the key-off touch operation, and detecting the forward stroke and the return stroke of the mass member by a second sensor to output key-on information in response to the key-on touch operation; and controlling the tone generator to generate the leading tone from the first sound source based on the key-on information outputted from the second sensor, and controlling the tone generator to generate the trailing tone from the second sound source based on the key-off information outputted from the first sensor.

28. A method of generating a tone in an electronic musical apparatus having a key member, a mass member and a tone generator containing a first sound source for generating a leading tone and a second sound source for generating a trailing tone, the method comprising the steps of:

operating the key member for performing a key-on touch operation in a forward stroke and a key-off touch operation in a return stroke so as to input a music note;

operating the mass member linked to the key member to undergo a forward stroke in response to the forward stroke of the key member for imparting a weight to the key-on touch operation, and to undergo a return stroke in response to the return stroke of the key member, wherein the mass member has a stroke span set greater than a stroke span of the key member;

detecting by a first sensor when the key member advances the return stroke in response to the key-off touch operation so as to output key-off information, and detecting by a second sensor when the mass member advances the forward stroke in response to the key-on touch operation so as to output key-on information; and controlling the tone generator to generate the leading tone from the first sound source based on the key-on information outputted from the second sensor, and controlling the tone generator to generate the trailing tone from the second sound source based on the key-off information outputted from the first sensor.

29. A medium for use in an electronic musical apparatus having a play member, a tone generator and a processor, the medium containing a program executable by the processor for causing the electronic musical apparatus to carry out a process comprising the steps of:

operating the play member in playing a music such that a key-on touch operation and a key-off touch operation are provided by the play member to input a note of the music;

detecting the key-on touch operation and the key-off touch operation to generate key-on information and key-off information; and controlling the tone generator to generate a tone corresponding to the note based on the key-on information and the key-off information, wherein the step of detecting detects a transitional state of the key-off touch operation for generating a sequence of first key-off information and second key-off information indicative of the transitional state of the key-off touch operation, and the step of controlling responds to the first key-off information for controlling the tone generator to start generating of a trailing tone of the note, and responds to the second key-off information for controlling the tone generator to stop generating of the trailing tone of the note.

30. A medium for use in an electronic musical apparatus having a play member, a tone generator and a processor, the medium containing a program executable by the processor for causing the electronic musical apparatus to carry out a process comprising the steps of:

operating the play member in playing a music such that a key-on touch operation and a key-off touch operation are performed on the play member to input a note of the music;

detecting the key-on touch operation and the key-off touch operation to generate key-on information and key-off information, wherein the step of detecting further detects a transitional state of the key-off touch operation for generating a sequence of first key-off information and second key-off information indicative of the transitional state of the key-off touch operation; and controlling the tone generator to generate a tone corresponding to the note based on the key-on information and the key-off information, wherein the step of controlling responds to the key-on information for controlling the tone generator to generate a leading tone of the note, and the step of controlling further responds to the first key-off information for controlling the tone generator to start generating of a trailing tone of the note and responds to the second key-off information for controlling the tone generator to stop generating of the trailing tone of the note.

31. A medium for use in an electronic musical apparatus having a play member, a tone generator and a processor, the medium containing a program executable by the processor for causing the electronic musical apparatus to carry out a process comprising the steps of:

operating the play member in playing a music such that a key-on touch operation and a key-off touch operation are performed on the play member to input a note of the music;

detecting the key-on touch operation and the key-off touch operation to generate key-on information and key-off information, wherein the step of detecting further detects a transitional state of the key-on touch operation for generating a sequence of first key-on information and second key-on information indicative of a time-variation of the key-on touch operation, and detects another transitional state of the key-off touch operation for generating a sequence of first key-off information and second key-off information indicative of the transitional state of the key-off touch operation; and controlling the tone generator to generate a tone corresponding to the note based on the key-on information and the key-off information, wherein the step of controlling responds to the first key-on information and the second key-on information for controlling the tone generator to generate a leading tone of the note, and the step of controlling further responds to the first key-off information for controlling the tone generator to start generating of a trailing tone of the note and responds to the second key-off information for controlling the tone generator to stop generating of the trailing tone of the note.

32. A medium for use in an electronic musical apparatus having a play member, a tone generator, a waveform memory and a processor, the medium containing a program executable by the processor for causing the electronic musical apparatus to carry out a process comprising the steps of:

operating the play member in playing a music such that a key-on touch operation and a key-off touch operation are provided by the play member to input a note of the music;

detecting the key-on touch operation and the key-off touch operation to output key-on information and key-off information; and controlling the tone generator to generate a tone associated to the note based on the key-on information and the key-off information, wherein the step of detecting detects a transitional state of the key-off touch operation for outputting a sequence of first key-off information and second key-off information indicative of the transitional state of the key-off touch operation, and the step of controlling controls the tone generator for reading out a waveform representing a tone corresponding to the key-off touch operation from the waveform memory in response to the first key-off information to thereby start generating of the tone corresponding to the key-off touch operation, and controls the tone generator to stop generating of the tone corresponding to the key-off touch operation in response to the second key-off information.

33. A medium for use in an electronic musical apparatus having a play member, a tone generator, a waveform memory and a processor, the medium containing a program executable by the processor for causing the electronic musical apparatus to carry out a process comprising the steps of:

operating the play member in playing a music such that a key-on touch operation and a key-off touch operation are performed on the play member to input a note of the music;

detecting the key-on touch operation and the key-off touch operation to output key-on information and key-off information, wherein the step of detecting detects a transitional state of the key-off touch operation for outputting a sequence of first key-off information and second key-off information indicative of the transitional state of the key-off touch operation; and controlling the tone generator to generate a tone associated to the note based on the key-on information and the key-off information, wherein the step of controlling controls the tone generator for reading out a leading waveform of the tone from the waveform memory in response to the key-on information, and the step of controlling further controls the tone generator to start reading of a trailing waveform of the tone from the waveform memory in response to the first key-off information, and to stop reading of the trailing waveform in response to the second key-off information.

34. A medium for use in an electronic musical apparatus having a play member, a tone generator, a waveform memory and a processor, the medium containing a program executable by the processor for causing the electronic musical apparatus to carry out a process comprising the steps of:

operating the play member in playing a music such that a key-on touch operation and a key-off touch operation are performed on the play member to input a note of the music;

detecting the key-on touch operation and the key-off touch operation to output key-on information and key-off information, wherein the step of detecting detects a transitional state of the key-on touch operation for outputting a sequence of first key-on information and second key-on information indicative of a time-variation of the key-on touch operation, and further detects another transitional state of the key-off touch operation for outputting a sequence of first key-off information and second key-off information indicative of the transitional state of the key-off touch operation; and controlling the tone generator to generate a tone associated to the note based on the key-on information and the key-off information, wherein the step of controlling controls the tone generator for reading out a leading waveform of the tone from the waveform memory according to the first key-on information and the second key-on information, and the step of controlling further controls the tone generator to start reading of a trailing waveform of the tone from the waveform memory in response to the first key-off information, and to stop reading of the trailing waveform in response to the second key-off information.

35. A medium for use in an electronic musical apparatus having a processor, a play member and a tone generator containing a first sound source for generating a first tone and a second sound source for generating a second tone, the medium containing a program executable by the processor for causing the electronic musical apparatus to carry out a process comprising the steps of:

operating the play member for playing a music such that a key-on touch operation and a key-off touch operation are provided by the play member to input a note of the music;

detecting the key-on touch operation to output key-on information and detecting the key-off touch operation to output key-off information;

controlling the tone generator to generate the first tone from the first sound source based on the key-on information;

controlling the tone generator to generate the second tone from the second sound source based on the key-off information; and further controlling the tone generator to regulate a duration of the second tone according to the key-off information.

36. A medium for use in an electronic musical apparatus having a processor, a key member, a mass member and a tone generator containing a first sound source for generating a leading tone and a second sound source for generating a trailing tone, the medium containing a program executable by the processor for causing the electronic musical apparatus to carry out a process comprising the steps of:

operating the key member for performing a key-on touch operation in a forward stroke and a key-off touch operation in a return stroke so as to input a music note;

operating the mass member linked to the key member to undergo a forward stroke in response to the forward stroke of the key member for imparting a weight to the key-on touch operation, and to undergo a return stroke in response to the return stroke of the key member, wherein the mass member has a stroke span set greater than a stroke span of the key member;

detecting the forward stroke and the return stroke of the key member by a first sensor to output key-off information in response to the key-off touch operation, and detecting the forward stroke and the return stroke of the mass member by a second sensor to output key-on information in response to the key-on touch operation; and controlling the tone generator to generate the leading tone from the first sound source based on the key-on information outputted from the second sensor, and controlling the tone generator to generate the trailing tone from the second sound source based on the key-off information outputted from the first sensor.

37. A medium for use in an electronic musical apparatus having a processor, a key member, a mass member and a tone generator containing a first sound source for generating a leading tone and a second sound source for generating a trailing tone, the medium containing a program executable by the processor for causing the electronic musical apparatus to carry out a process comprising the steps of:

operating the key member for performing a key-on touch operation in a forward stroke and a key-off touch operation in a return stroke so as to input a music note;

operating the mass member linked to the key member to undergo a forward stroke in response to the forward stroke of the key member for imparting a weight to the key-on touch operation, and to undergo a return stroke in response to the return stroke of the key member, wherein the mass member has a stroke span set greater than a stroke span of the key member;

detecting by a first sensor when the key member advances the return stroke in response to the key-off touch operation so as to output key-off information, and detecting by a second sensor when the mass member advances the forward stroke in response to the key-on touch operation so as to output key-on information; and controlling the tone generator to generate the leading tone from the first sound source based on the key-on information outputted from the second sensor, and controlling the tone generator to generate the trailing tone from the second sound source based on the key-off information outputted from the first sensor.

* * * * *